US011674277B2

(12) United States Patent
Landry

(10) Patent No.: US 11,674,277 B2
(45) Date of Patent: Jun. 13, 2023

(54) EXTENSIBLE SNOWBLOWER

(71) Applicant: 9277-9347 QUÉBEC INC., Ste-Geneviève de Berthier (CA)

(72) Inventor: Jocelyn Landry, Ste-Geneviève de Berthier (CA)

( * ) Notice: Subject to any disclaimer, the term of this patent is extended or adjusted under 35 U.S.C. 154(b) by 215 days.

(21) Appl. No.: 16/844,970

(22) Filed: Apr. 9, 2020

(65) Prior Publication Data

US 2020/0325644 A1 Oct. 15, 2020

Related U.S. Application Data

(60) Provisional application No. 62/831,947, filed on Apr. 10, 2019.

(51) Int. Cl.
*E01H 5/09* (2006.01)
*E01H 5/04* (2006.01)

(52) U.S. Cl.
CPC ..... *E01H 5/098* (2013.01); *E01H 5/045* (2013.01)

(58) Field of Classification Search
CPC ..... E01H 5/098; E01H 5/045; B65G 33/26; B65G 33/08
See application file for complete search history.

(56) References Cited

U.S. PATENT DOCUMENTS 2,845,167 A * 7/1958 Heiken ..... B65G 33/24 198/660
3,605,995 A * 9/1971 Maack ..... B65G 33/26 198/662
4,356,910 A * 11/1982 Togstad ..... B65G 33/32 198/666
4,772,156 A * 9/1988 Craig ..... E01C 19/42 404/104
5,410,824 A * 5/1995 Pedersen ..... E01H 5/04 37/214
5,871,081 A * 2/1999 Gaalswyk ..... G01F 13/005 198/662
5,980,153 A * 11/1999 Plemons ..... E01C 19/185 404/115
6,212,799 B1 * 4/2001 Gingerich ..... E01H 5/04 37/246
7,381,131 B1 * 6/2008 Harpole ..... A01F 12/46 198/671

(Continued)

FOREIGN PATENT DOCUMENTS

CA 2 872 166 11/2013

*Primary Examiner* — Jessica H Lutz
(74) *Attorney, Agent, or Firm* — Peterson IP; Brett Peterson

(57) ABSTRACT

A snowblower comprises an auger housing extending along a longitudinal axis and being configurable in a compacted configuration and in an extended configuration wherein a length of the auger housing considered along the longitudinal axis is greater in the at least one extended configuration than in the compacted configuration; and an auger assembly mounted to the auger housing and comprising: a telescopic drive shaft assembly including at least first and second shaft sections slidably mounted to each other to substantially conform to the length of the auger housing in each one of the compacted configuration and the at least one extended configuration; and snow-gathering devices mounted to the at least first and second shaft sections and rotatable therewith.

20 Claims, 15 Drawing Sheets

(56) References Cited

U.S. PATENT DOCUMENTS

| | | | | |
|---|---|---|---|---|
| 8,122,619 | B2 * | 2/2012 | Embry | E01H 5/04 37/196 |
| 8,746,439 | B2 * | 6/2014 | Houssian | B65G 33/24 198/660 |
| 9,068,298 | B2 * | 6/2015 | Everett | E01C 19/187 |
| 9,376,261 | B1 * | 6/2016 | Miller | E01H 5/076 |
| 10,894,666 | B2 * | 1/2021 | Bergkamp | B65G 33/265 |
| 2014/0130384 | A1 * | 5/2014 | Favorito | E01H 5/04 37/242 |
| 2020/0339359 | A1 * | 10/2020 | Bergkamp | A01F 12/46 |
| 2021/0222377 | A1 * | 7/2021 | Schenkelberg | E01C 19/187 |
| 2021/0262183 | A1 * | 8/2021 | Favorito | E01H 5/076 |
| 2021/0277616 | A1 * | 9/2021 | Girouard | E01H 5/045 |

* cited by examiner

EXTENSIBLE SNOWBLOWER

PRIOR APPLICATION

The present application claims priority from U.S. provisional patent application No. 62/831,947, filed on Apr. 10, 2019, and entitled "EXTENSIBLE SNOWBLOWER", the disclosure of which being hereby incorporated by reference in its entirety.

TECHNICAL FIELD

The technical field relates to apparatuses for removing snow, and more particularly to snowblowers.

BACKGROUND

Snowblowers are commonly used to remove snow from ground surfaces, such as roads or pathways. However, the snowblowers are not always adapted to dimensions of the road from which snow needs to be removed: either the snowblower is not long enough compared to a width of the road, thus requiring multiple passes of the snowblower, or the snowblower is too long compared to the width of the road, in which case the snowblower cannot be used to remove the snow from the ground surface of the road and/or might damage areas bordering the road.

In view of the above, there is a need for a snowblower which would be easily adaptable to ground surfaces of roads or pathways having different widths.

BRIEF SUMMARY

It is therefore an aim of the present invention to address the above-mentioned issues.

According to a general aspect, there is provided a snowblower, comprising an auger housing extending along a longitudinal axis and being configurable in a compacted configuration and in at least one extended configuration wherein a length of the auger housing considered along the longitudinal axis is greater in the at least one extended configuration than in the compacted configuration; and an auger assembly mounted to the auger housing and comprising: a telescopic drive shaft assembly including at least first and second shaft sections slidably mounted to each other to substantially conform to the length of the auger housing in each one of the compacted configuration and the at least one extended configuration; and snow-gathering devices mounted to the at least first and second shaft sections and rotatable therewith.

According to another general aspect, there is provided a snowblower, comprising: an extensible auger housing extending along a longitudinal axis and comprising first and second longitudinal end portions defining an auger length in-between, wherein the first and second longitudinal end portions are displaceable with respect to each other for the extensible auger housing to be configurable in: a compacted configuration wherein the extensible auger housing has a compacted auger length, and at least one extended configuration wherein the extensible auger housing has an extended auger length greater than the compacted auger length; and an auger assembly mounted to the extensible auger housing and extending between the first and second longitudinal end portions, the auger assembly comprising at least first and second auger members translating relatively to one another along a direction substantially parallel to the longitudinal axis upon displacement of at least one of the first and second longitudinal end portions.

According to another general aspect, there is provided a walk-behind snowblower assembly, comprising: a chassis having a front portion, a rear portion and a handle member extending from the rear portion; and a snowblower according to the present disclosure mounted to the front portion of the chassis.

According to another general aspect, there is provided a motorized snowblower assembly, comprising: a motorized vehicle having a front portion and a rear portion; and a snowblower according to the present disclosure mounted to one of the front and rear portions.

According to another general aspect, there is provided a snowblower, comprising an auger housing extending along a longitudinal axis and defining an auger-containing cavity, the auger housing being configurable in a compacted configuration and in at least one extended configuration wherein a length of the auger housing considered along the longitudinal axis in the at least one extended configuration is greater than in the compacted configuration and an auger assembly mounted to the auger housing and extending in the auger-containing cavity. The auger assembly comprises an extendable drive shaft including at least two shaft sections translatable with respect to one another to conform to the length of the auger housing when configured in the compacted configuration and in the at least one extended configuration; and snow-gathering devices mounted to the at least two shaft sections.

According to another general aspect, there is provided a snowblower, comprising an auger housing extending along a longitudinal axis and defining an auger-containing cavity, the auger housing comprising first and second lateral portions and a rear wall, the first and second lateral portions being slidably mounted to the rear wall; and an auger assembly mounted to the auger housing and extending in the auger-containing cavity between the first and second lateral portions. The auger assembly comprises first and second auger members; the first and second auger members translating relatively to one another simultaneously with the first and second lateral portions. The auger housing is configurable into a compacted configuration wherein the auger assembly has a compacted length considered along the longitudinal axis, and at least one extended configuration wherein the auger assembly has a length, considered along the longitudinal axis, greater than the compacted length.

According to another general aspect, there is provided a motorized vehicle comprising a front portion and a rear portion; and a snowblower according to the present disclosure mounted to one of the front and rear portions.

DETAILED DESCRIPTION

Figure 1:
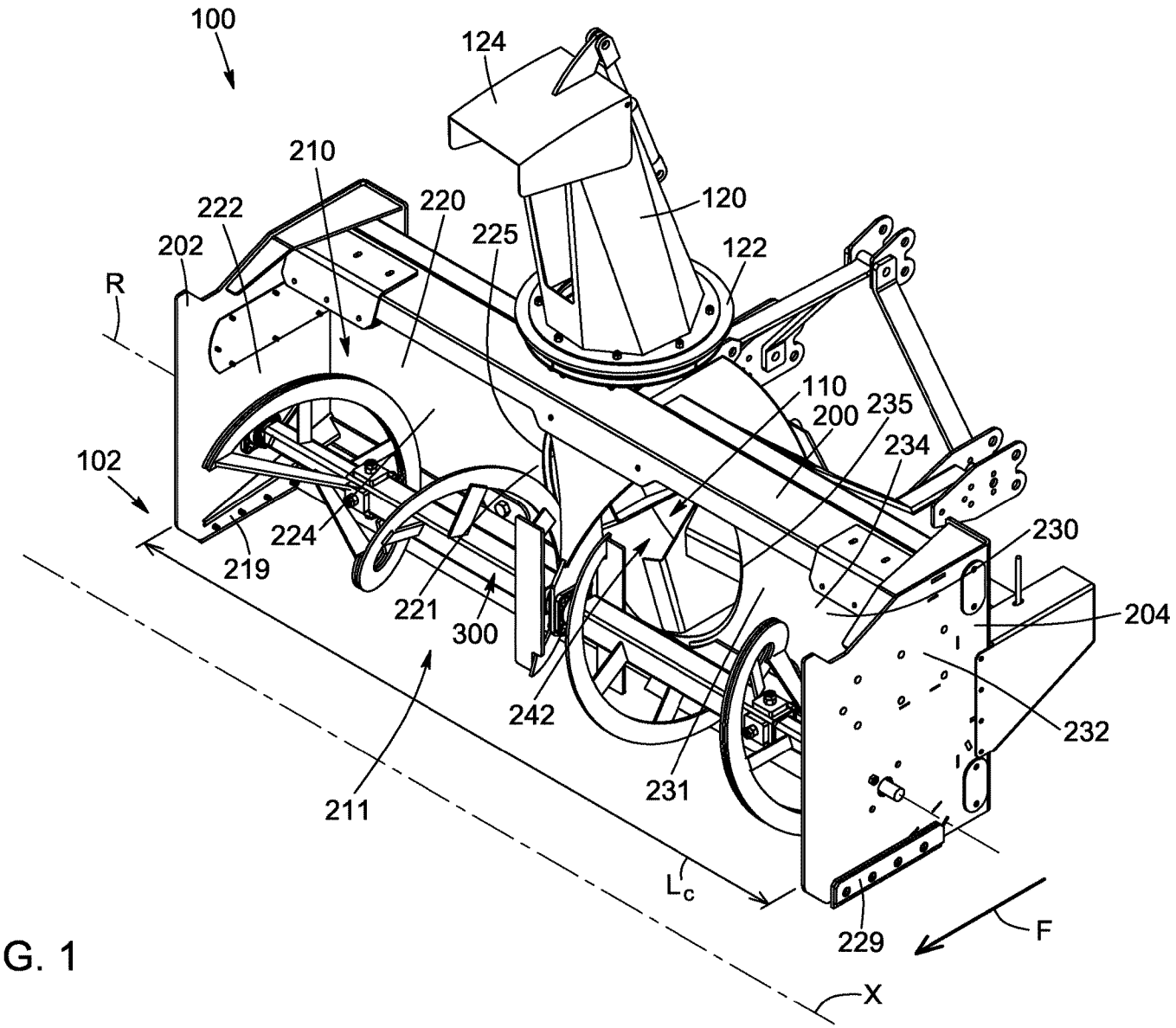
FIG. 1 is a front perspective view of an extensible snowblower in accordance with an embodiment, the snowblower comprising an auger housing configured in a compacted configuration, and an auger assembly mounted to the auger housing and comprising a drive shaft-stabilizing assembly.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "forward", "rearward", "left", "right" and the like should, unless otherwise indicated, be taken in the context of the figures only and should not be considered limiting. Moreover, the figures are meant to be illustrative of certain characteristics of the snowblower and are not necessarily to scale.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, an embodiment is an example or implementation. The various appearances of "one embodiment", "an embodiment" or "some embodiments" do not necessarily all refer to the same embodiments. Although various features may be described in the context of a single embodiment, the features may also be provided separately or in any suitable combination. Conversely, although the invention may be described herein in the context of separate embodiments for clarity, it may also be implemented in a single embodiment. Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only. The principles and uses of the teachings of the present disclosure may be better understood with reference to the accompanying description, figures and examples. It is to be understood that the details set forth herein do not construe a limitation to an application of the disclosure.

Furthermore, it is to be understood that the disclosure can be carried out or practiced in various ways and that the disclosure can be implemented in embodiments other than the ones outlined in the description above. It is to be understood that the terms "including", "comprising", and grammatical variants thereof do not preclude the addition of one or more components, features, steps, or integers or groups thereof and that the terms are to be construed as specifying components, features, steps or integers. If the specification or claims refer to "an additional" element, that does not preclude there being more than one of the additional element. It is to be understood that where the claims or specification refer to "a" or "an" element, such reference is not be construed that there is only one of that element. It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only. Meanings of technical and scientific terms used herein are to be commonly understood as by one of ordinary skill in the art to which the invention belongs, unless otherwise defined. It will be appreciated that the methods described herein may be performed in the described order, or in any suitable order.

Referring now to the drawings, and more particularly to FIGS. 1 to 13, there is shown a snowblower 100, 1100 in accordance with two embodiments of the present disclosure. The snowblower 100, 1100 comprises an auger housing 200, 1200 (or extensible auger housing 200, 1200) extending along a longitudinal axis X and defining an auger-containing cavity 210, 1210. The snowblower 100, 1100 further comprises an auger assembly 300, 1300 mounted to the auger housing 200, 1200 and extending in the auger-containing cavity 210, 1210. As detailed below, the auger assembly is dividable in a plurality of auger members.

It is known that such snowblowers, sometimes referred to as two-stage snowblowers, are configured so that the auger assembly 300 pulls snow into the snowblower 100 (or into the auger-containing cavity thereof), conveys the snow towards an impeller 110 and feed the snow into the impeller 110 which in turn directs the snow out of a snow discharge chute 120, extending substantially upwardly (substantially vertically in the embodiment shown), so as to throw the snow to another location or into a truck to be hauled away.

Figure 14:
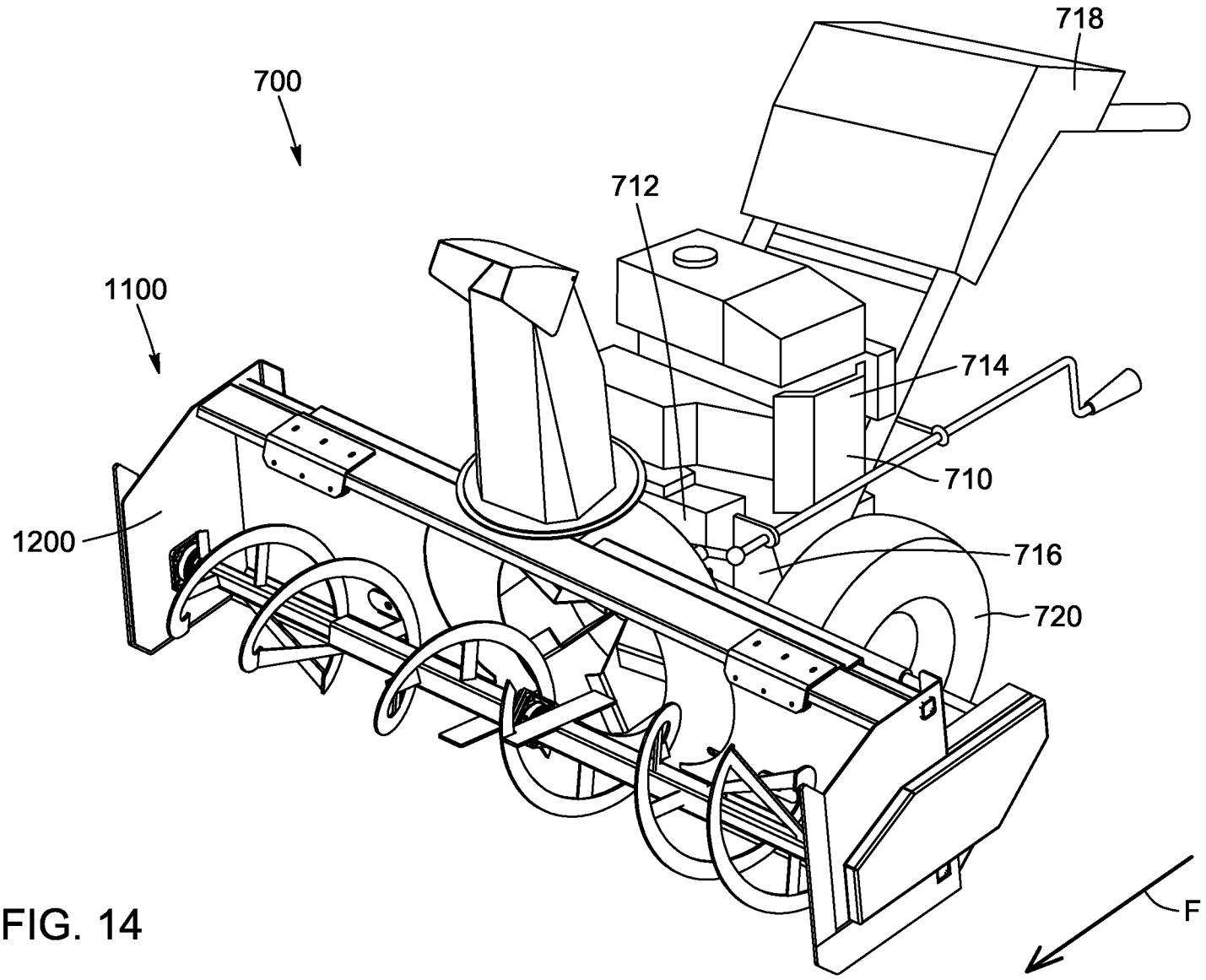
FIG. 14 is a front perspective view of a walk-behind snowblower assembly comprising a chassis having a front portion with the snowblower of FIG. 13 mounted thereto.

For instance and without being limitative, such snowblowers might be of the walk-behind type, as best shown in FIG. 14, which represents a walk-behind snowblower assembly 700 comprising a chassis 710 having a front portion 712, a rear portion 714 and a lower portion 716; the terms rear and front are relative to a forward direction F of displacement of the walk behind snowblower assembly 700 while being used. The auger housing 1200 of the snowblower 1100 is usually mounted to the front portion 712 of the chassis 710, whereas a handle member 718 extends from the rear portion 714 for a user to walk behind the snowblower 1100. The walk-behind snowblower assembly 700 also comprises locomotion actuators 720 (such as wheels, as best shown in FIG. 14, or caterpillar tracks) mounted to the lower portion 716 of the chassis 710 for the snowblower 1100 to be easily displaceable on a ground surface.

Figure 9:
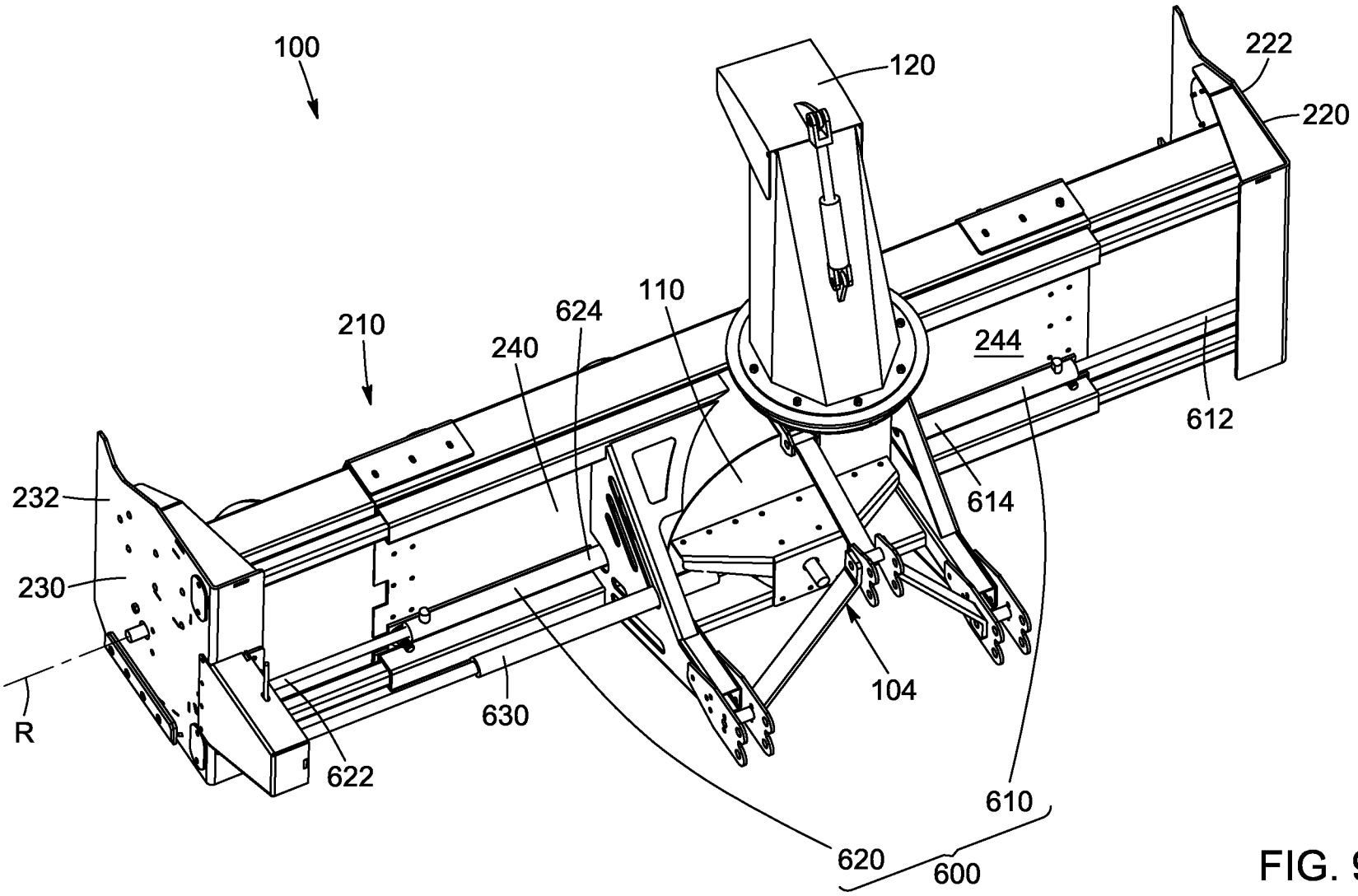
FIG. 9 is a rear perspective view of the snowblower of FIG. 1, the auger housing being configured in the extended configuration.
Figure 15:
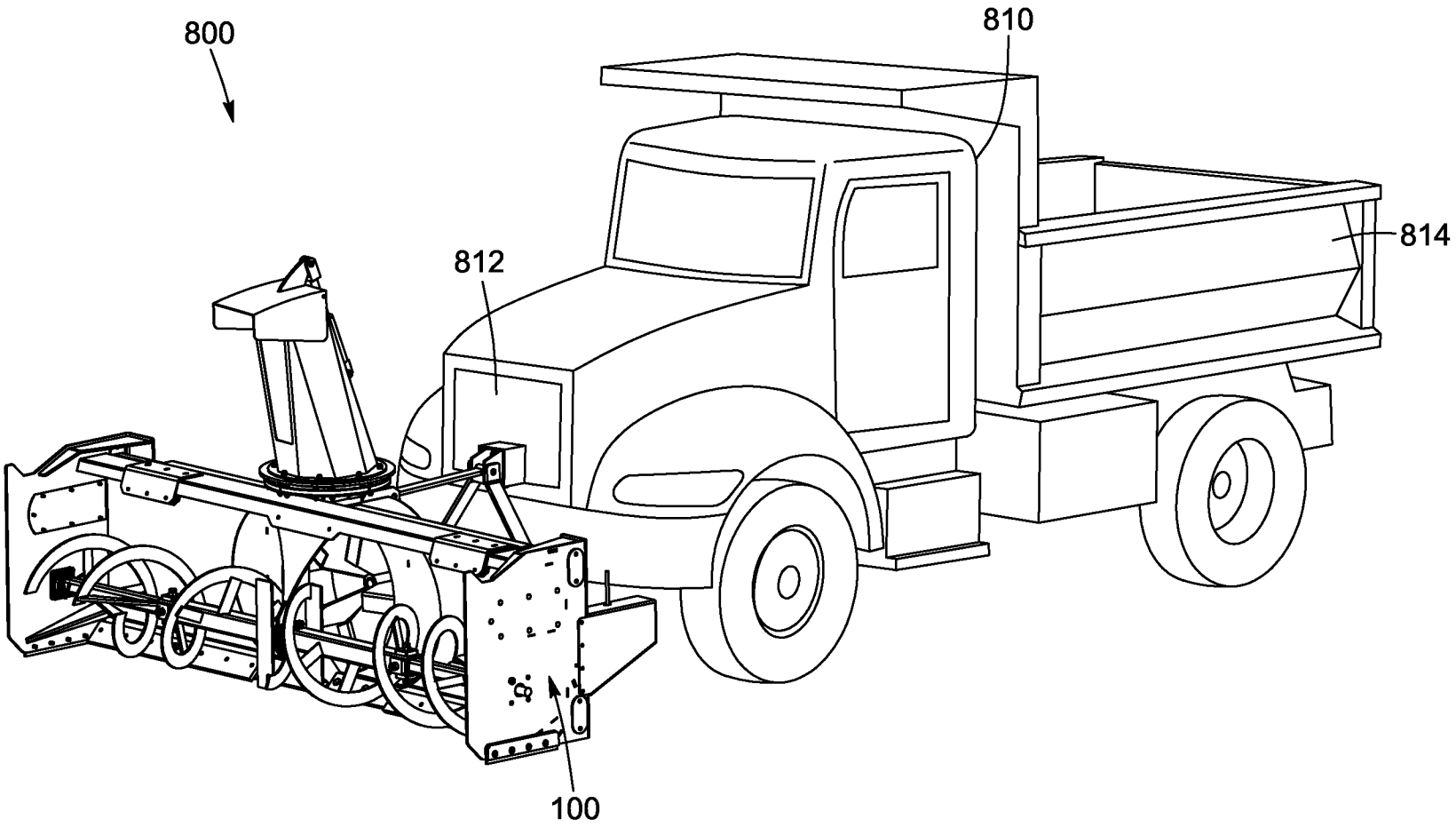
FIG. 15 is a front perspective view of a motorized snowblower assembly comprising a motorized vehicle having a front portion with the snowblower of FIG. 1 mounted thereto.

The present disclosure is not limited to walk-behind two-stage snowblowers, and the auger housing 200 with the auger assembly 300 mounted thereto according to the present disclosure could also equip other types of snowblowers, such as snowblowers configured to be mounted to a front portion or a rear portion of a loader truck or any other type of motorized vehicle. As best shown in FIG. 15, there is disclosed a motorized snowblower assembly 800 comprising a motorized vehicle 810 (such as, for instance, a truck) having a front portion 812 and a rear portion 814. The motorized snowblower assembly 800 further comprises a snowblower 100 in accordance with the present disclosure, mounted to one of the front and rear portions 812, 814 of the motorized vehicle 810 (to the front portion 812 thereof, in the embodiment shown). In the embodiment shown, the motorized snowblower assembly 800 is configured to displace the snowblower 100 in a forward direction corresponding to a forward direction of the motorized vehicle 810. To this end, as best shown in FIG. 9, the snowblower 100 comprises a vehicle-mounting assembly 104, at a rear portion thereof, that is shaped and dimensioned to allow the mounting of the snowblower 100 to vehicles of different types, shapes and/or dimensions.

It could also be conceived a motorized snowblower assembly having a snowblower mounted to a rear portion thereof with the motorized snowblower assembly being also configured to displace the snowblower in a forward direction corresponding to a forward direction of the motorized vehicle. To this end, the auger-containing cavity would be directed towards the motorized vehicle, and not in a direction opposed to the motorized vehicle, as in the embodiment represented in FIG. 15. The snowblower would thus comprise a vehicle-mounting assembly for instance protruding inwardly from the auger housing, for it to extend at least partially in the auger-containing cavity. In this embodiment (not represented), it is thus understood that the snowblower would be pulled by the motorized vehicle, on the contrary of the embodiment represented in FIG. 15 wherein the snowblower 100 is pushed by the motorized vehicle 810.

The extensible auger housing 200 according to the present disclosure is configurable into a compacted configuration (FIG. 1) and at least one extended configuration (FIG. 2), wherein a length Le (or auger length Le) of the auger housing 200 in the at least one extended configuration considered along the longitudinal axis X is greater than a length Lc (or auger length Lc) when the auger housing 200 is configured in the compacted configuration. In other words, the extensible auger housing 200 comprises first and second longitudinal end portions 202, 204 defining the auger length in-between, wherein the first and second longitudinal end portions 202, 204 are displaceable with respect to each other for the extensible auger housing 200 to be configurable at least in the compacted configuration wherein the extensible auger housing 200 has the compacted auger length Lc, and in the at least one extended configuration wherein the extensible auger housing 200 has the extended auger length Le greater than the compacted auger length Lc.

In some embodiments, the length Le (or extended auger length Le) of the auger housing 200 when configured in the at least one extended configuration is comprised between about 5 feet and about 40 feet. In some other embodiments, the length Le of the auger housing 200 when configured in the at least one extended configuration is comprised between about 10 feet and about 20 feet. In yet some other embodiments, the length Le of the auger housing 200 when configured in the at least one extended configuration is comprised between about 12 feet and about 16 feet.

In some embodiments, the length Lc (or compacted auger length Lc) of the auger housing 200 when configured in the compacted configuration is comprised between about 2 feet and about 10 feet. In some other embodiments, the length Lc of the auger housing 200 when configured in the compacted configuration is comprised between about 3 feet and about 9 feet.

In some embodiments, the compacted auger length Lc is less than about 90% of the extended auger length Le. In some other embodiments, the compacted auger length Lc is less than about 80% of the extended auger length Le. In some other embodiments, the compacted auger length Lc is less than about 60% of the extended auger length Le. In yet some other embodiments, the compacted auger length Lc is less than about 50% of the extended auger length Le.

As detailed below, the extensible auger housing 200 according to the present disclosure could also be configurable into one or more intermediate configurations (FIG. 3) wherein a length Li (or intermediate auger length Li) of the auger housing 200 considered along the longitudinal axis X when configured in the intermediate configuration is comprised between the length Le (or extended auger length Le) when in the at least one extended configuration and the length Lc (or compacted auger length Lc) when in the compacted configuration.

Extensible Auger Housing

In the embodiment shown, the extensible auger housing 200 comprises first and second lateral portions 220, 230 comprising respectively the first and second longitudinal end portions 202, 204. The first and second lateral portions 220, 230 are displaceable with respect to each other. In the embodiment shown, the first and second lateral portions 220, 230 are slidably mounted to each other, either directly or indirectly, along a direction substantially parallel to the longitudinal axis X of the extensible auger housing 200. The telescopic drive shaft assembly 300 is mounted to the first and second lateral portions 220, 230. In other words, the telescopic dive shaft assembly 300 comprises first and second distal shaft end portions mounted respectively to the first and second lateral portions 220, 230.

The auger housing 200 further comprises a rear wall 240 extending in a plane substantially vertical and substantially parallel to the longitudinal axis X of the auger housing 200. For instance, at least one of the first and second lateral portions 220, 230 is slidably mounted to the rear wall 240. It is thus understood that in the embodiment shown, the first and second lateral portions 220, 230 are indirectly slidably mounted to each other, via the rear wall 240. Other embodiments wherein the first and second lateral portions would be directly slidably mounted to each other could also be conceived.

In the embodiment shown, a discharge opening 242 is formed in the extensible auger housing 200, for instance in the rear wall 240 thereof, for instance substantially centrally therein. The discharge opening 242 might have a substantially circular shape.

It could also be conceived an auger housing having no rear wall, or/and wherein the first and second lateral portions would be directly slidably mounted to each other and/or wherein the discharge opening 242 would have any other shape and/or would be arranged at a different location of the extensible auger housing.

The impeller 110 at least partially extends in the discharge opening 242. The snow discharge chute 120 of the snowblower 100 is mounted, in the embodiment shown, to the rear wall 240 (for instance to an upper portion thereof) and extends substantially upwardly (substantially vertically in the embodiment shown) from the discharge opening 242. In the embodiment shown, the snow discharge chute 120 is pivotally mounted to the auger housing 200 about a substantially vertical rotation axis, so as to modify the direction of the throwing of the snow out of the snow discharge chute 120 upon actuation of the snowblower 100. Moreover, in the embodiment shown, as represented for instance in FIG. 1, the snow discharge chute 120 comprises an upper hood 124 pivotally mounted to an upper end portion of the snow discharge chute 120 about a substantially horizontal pivoting axis to adjust the direction of the throwing of the snow upon actuation of the snowblower 100.

The snow discharge chute 120 defines a snow discharge cavity in fluid communication, via the discharge opening 242 formed in the rear wall 240, with the auger-containing cavity 210, for snow collected in the auger-containing cavity 210 upon displacement of the snowblower 100 and/or upon actuation of the auger assembly 300 to be thrown to another location, via the snow discharge chute 120.

As best shown in FIG. 1, a pivoting assembly 122, for instance having a substantially annular shape, is arranged between the snow discharge chute 120 and the rear wall 240 of the extensible auger housing 200 and is shaped and dimensioned to allow pivoting of the snow discharge chute 120 with respect to the auger housing 200. The pivoting assembly 122 is further shaped and dimensioned to provide a fluid-tight connection between the snow discharge chute 120 and the extensible auger housing 200, in order to limit the risk that a fluid, such as snow, circulating from the auger-containing cavity 210 to the snow discharge cavity defined by the snow discharge chute 120, via the discharge opening 242, would leak at a connection between the snow discharge chute 120 and the extensible auger housing 200.

In the embodiment shown, the first and second lateral portions 220, 230 of the extensible auger housing 200 at least partially border the discharge opening 242 formed therein when configured in the compacted configuration. More particularly, each of the first and second lateral portions 220, 230 comprises a proximal end portion 221, 231 having an inner edge 225, 235 (with a substantially arcuate profile, in the embodiment shown) bordering at least partially the discharge opening 242.

In the following description, the terms proximal and distal, unless otherwise stated, will be understood with regards to the portion of the auger-containing cavity 210 proximate the discharge opening 242 (i.e. with regards to a central portion 212 of the auger-containing cavity 210, in the embodiment shown). Moreover, unless otherwise stated, the terms inner and outer will be understood with regards to the auger-containing cavity 210.

In the embodiment shown, each of the first and second lateral portions 220, 230 comprises a sidewall 222, 232 and a lateral wall portion 224, 234 extending transversally (substantially perpendicularly) to the corresponding sidewall 222, 232. In the embodiment shown, the sidewalls 222, 232 of the first and second lateral portions 220, 230 comprise respectively the first and second longitudinal end portions 202, 204 of the extensible auger housing 200. The above-mentioned first and second distal shaft end portions are mounted respectively to the sidewalls 222, 232 of the first and second lateral portions 220, 230. The sidewalls 222, 232 extend for instance in a substantially transversal plane with regards to the longitudinal axis X. In the embodiment shown, the sidewalls 222, 232 extend substantially vertically, for instance substantially perpendicularly to the longitudinal axis X. It could also be conceived sidewalls that would diverge towards a snow inlet 211 of the auger housing 200. In the embodiment shown, the lateral wall portions 224, 234 extend in a substantially vertical plane, substantially parallel to the longitudinal axis X. The lateral wall portions 224, 234 comprise the proximal end portions 221, 231 bordering at least partially the discharge opening 242 when configured in the compacted configuration.

Figure 10:
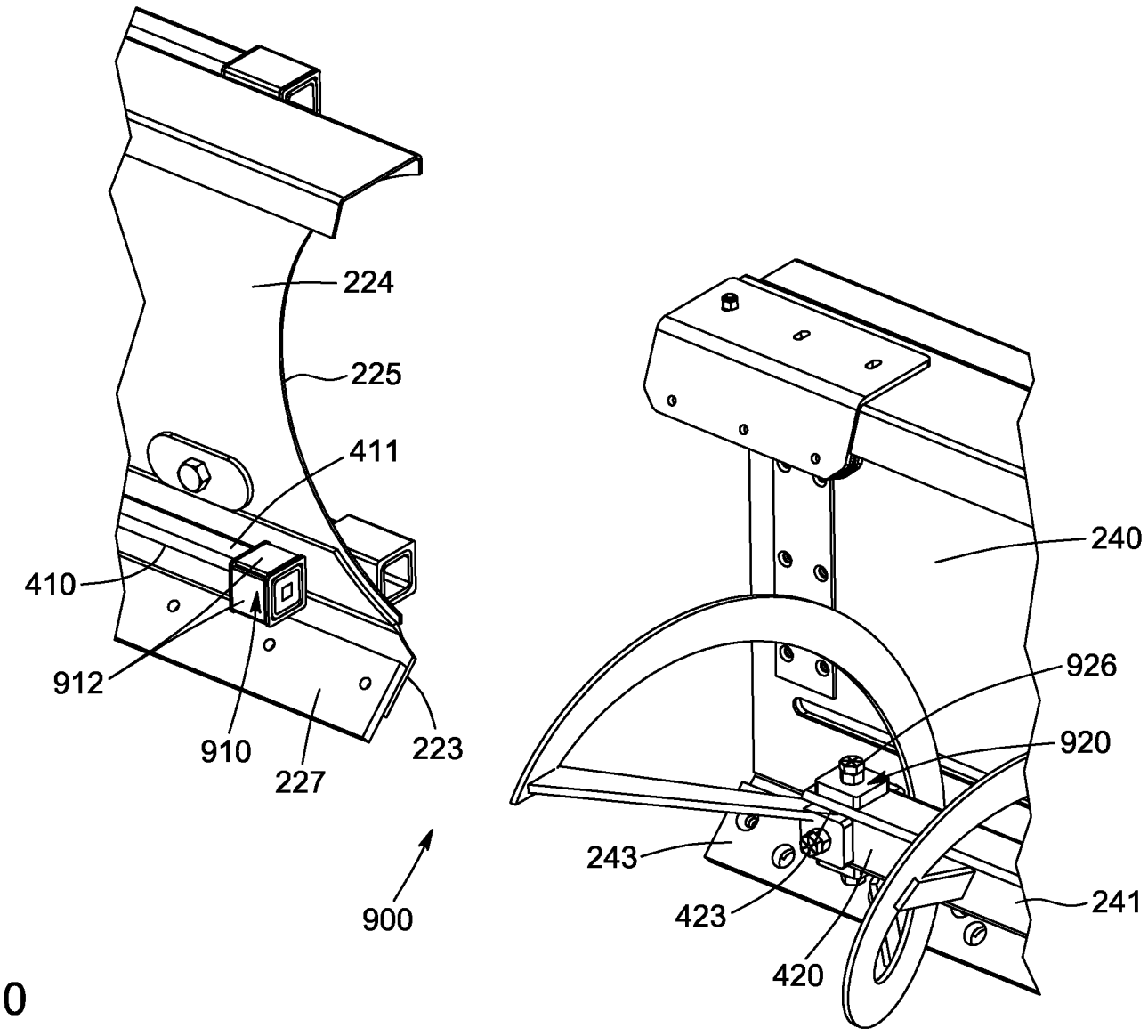
FIG. 10 is a right front perspective view, partially exploded, of the drive shaft-stabilizing assembly of FIG. 1.
Figure 11:
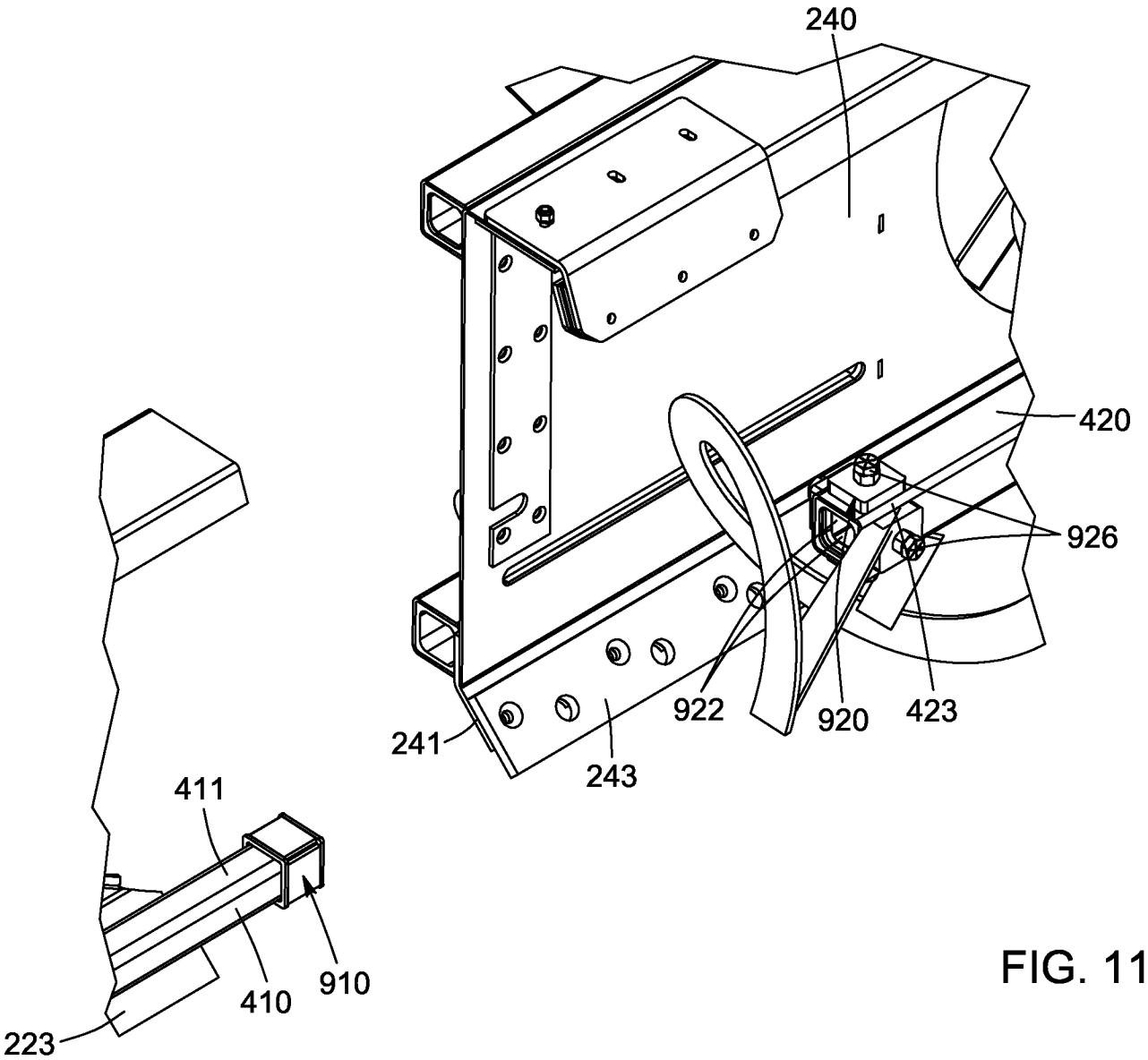
FIG. 11 is a left front perspective view, partially exploded, of the drive shaft-stabilizing assembly of FIG. 1.

In the embodiment shown, as best represented in FIGS. 10 and 11, the lateral wall portions 224, 234 of the first and second lateral portions 220, 230, as well as the rear wall 240 of the auger housing 200, comprise an inclined lower edge portion 223, 241, the lower end portion being inclined downwardly towards the auger-containing cavity 210 (i.e. towards the snow inlet 211) so as to help directing snow towards the auger-receiving cavity 210 and/or towards the discharge opening 242 formed in the auger housing 200 upon displacement of the snowblower 100. It is thus understood that a lower edge portion of the auger housing 200, at least partially formed by the lower edge portions of the lateral wall portions 224, 234 and the rear wall 240 is shaped and dimensioned to remove material, such as ice or snow, from a ground surface. In the embodiment shown, the auger housing 200 further comprises replaceable snow blades 227, 243 removably secured (for instance riveted) to the respective lower edge portions of the lateral wall portions 224, 234 and the rear wall 240 so as to limit wearing of the lateral wall portions 224, 234 and the rear wall 240 of the auger housing 200 upon displacement of the snowblower 100 on the ground surface.

As best shown in FIG. 1, the auger housing 200 also comprises replaceable skids 219, 229 detachably (or removably) mounted (for instance riveted) to the sidewalls 222, 232, to the lower portions thereof. In the embodiment shown, the replaceable skids 219, 229 have a substantially L-shaped cross section, with a first portion extending substantially vertically and secured, for instance, to an outer surface of the lower portion of the corresponding sidewall 222, 232. The replaceable skids 219, 229 further comprise a second portion extending substantially horizontally towards the auger-containing cavity 210. The replaceable skids 219, 229 are shaped and dimensioned to contribute to the limiting of the wearing of the sidewalls 222, 232 of the auger housing 200 upon displacement of the snowblower 100 on the ground surface.

Figure 7:
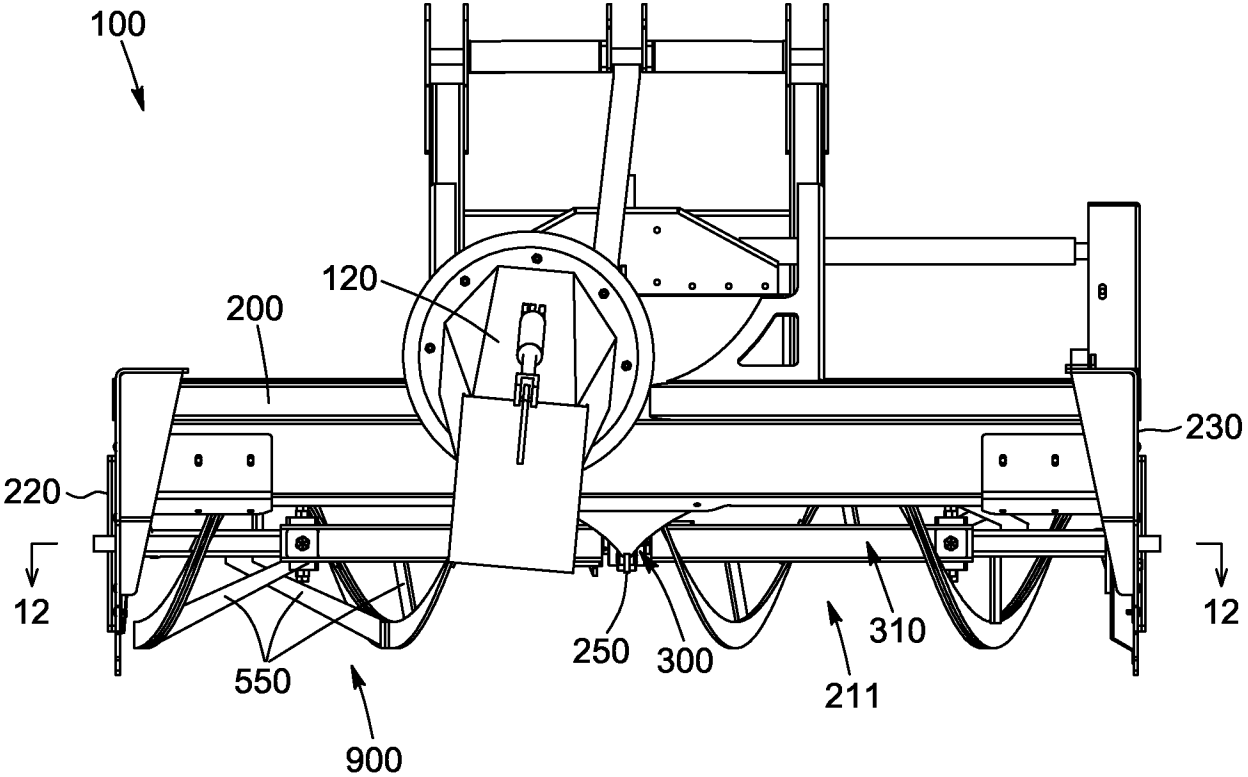
FIG. 7 is a top elevation view of the snowblower of FIG. 1, the auger housing being configured in the compacted configuration.
Figure 8:
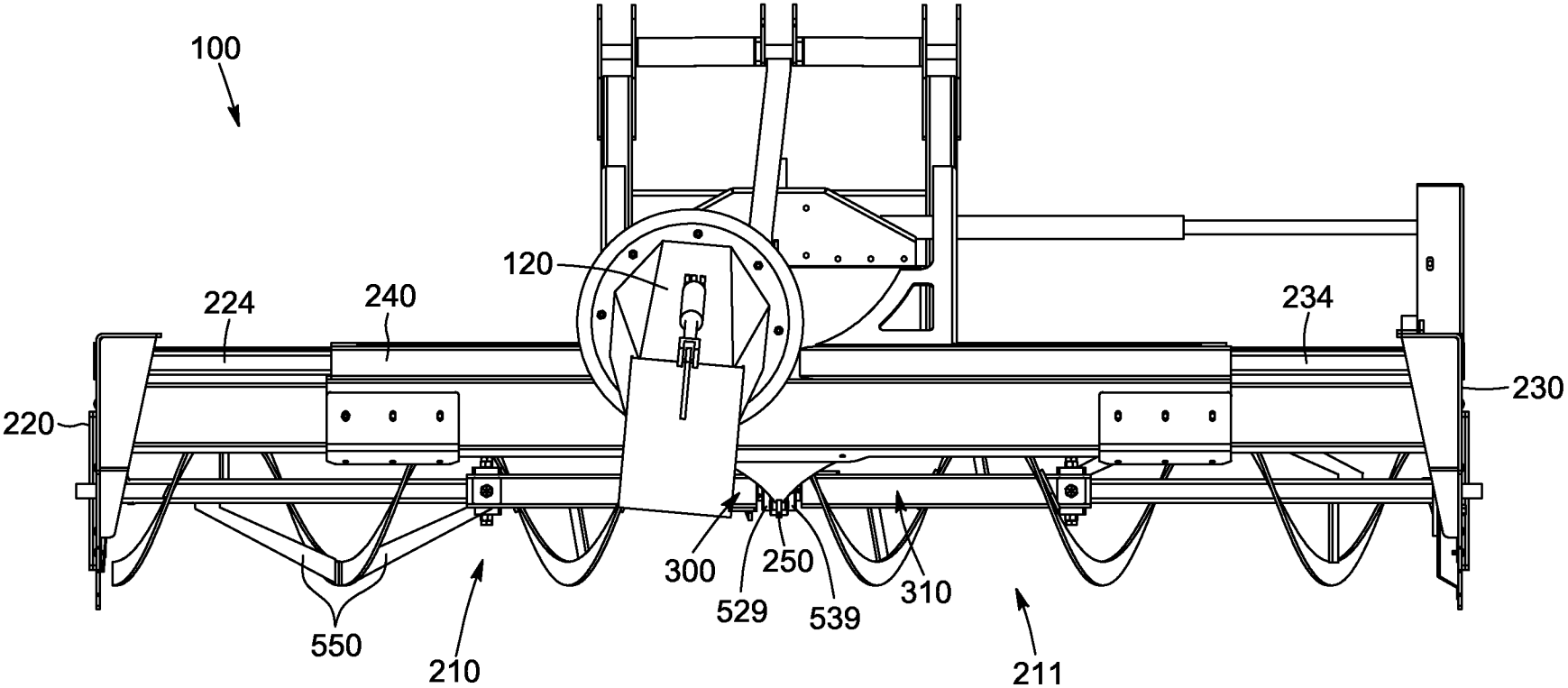
FIG. 8 is a top elevation view of the snowblower of FIG. 1, the auger housing being configured in the extended configuration.

It is thus understood that the auger housing 200 is substantially U-shaped when viewed from above, as represented in FIGS. 7 and 8. The auger-containing cavity 210 thus forms the above-mentioned snow inlet 211 (FIG. 1)

opening towards a front portion 102 of the snowblower 100, so as to collect snow in the auger-containing cavity 210 upon displacement of the snowblower 100 along a forward direction F (FIG. 1) and/or actuation of the auger assembly 300. It is appreciated that the shape of the auger-containing cavity 210 can vary from the embodiment shown, as long as the auger-containing cavity 210 forms a snow inlet 211 opening towards the front portion of the snowblower 100.

It is appreciated that the shape and the configuration of the auger housing 200, as well as the shape, the configuration and the relative arrangement of the rear wall 240 and the first and second lateral portions 220, 230 can vary from the embodiment shown. For instance, it could be conceived an extensible auger housing comprising a plurality of substantially concave wall portions slidably mounted relative to each other, either directly or indirectly, or slidable wall portions of any other shape. It could also be conceived an extensible auger housing with first and second lateral portions having no sidewall, the lateral wall portions having for instance an inner surface defining a concavity, the lateral wall portions being slidably mounted to the rear wall comprising, for instance, an inner surface defining a concavity with a substantially similar curvature.

Auger Assembly

Figure 5:
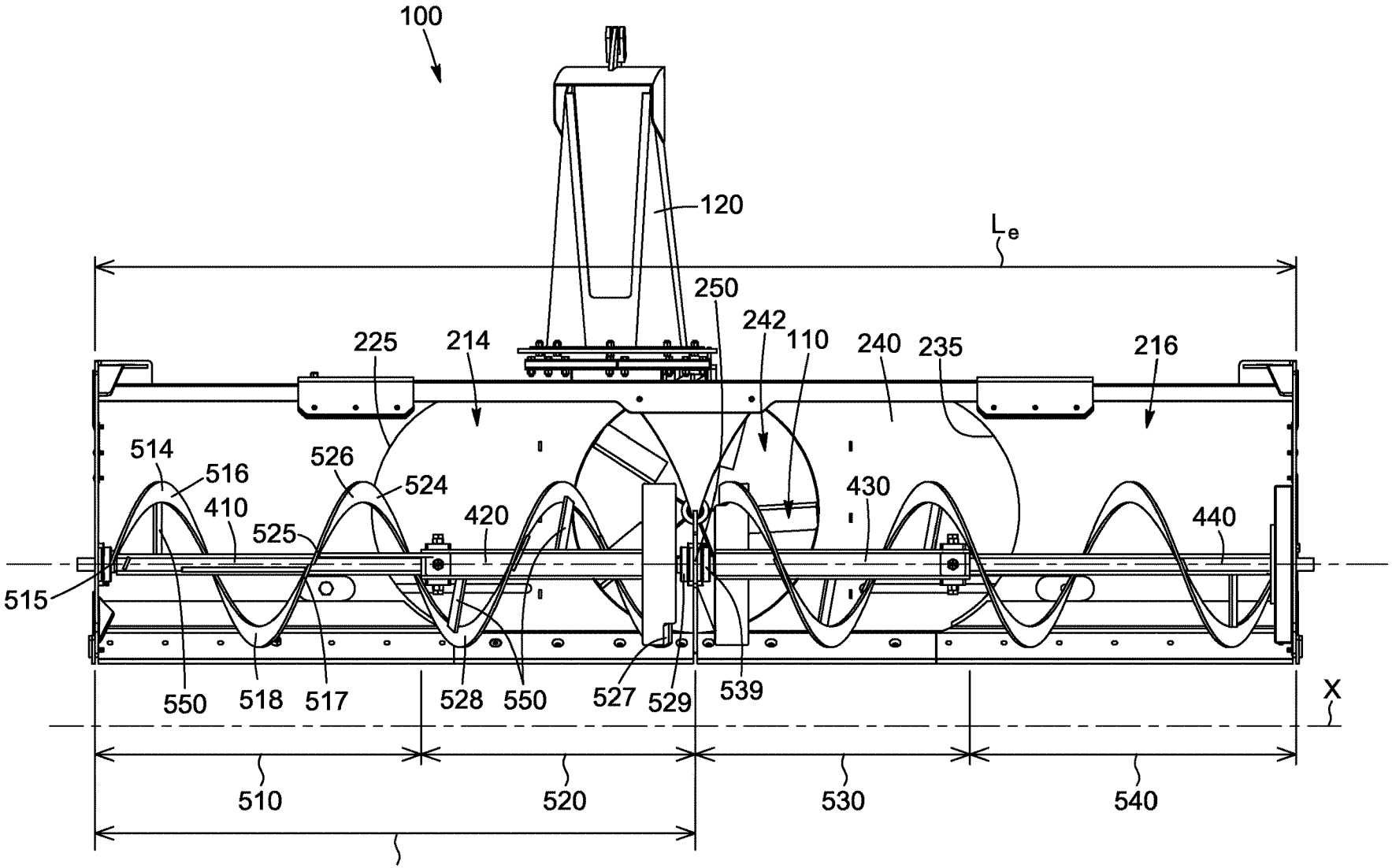
FIG. 5 is a front elevation view of the snowblower of FIG. 1, the auger housing being configured in the extended configuration.

The auger assembly 300 mounted to the extensible auger housing 200 and extending in the auger-containing cavity 210 comprises an extendable (or telescopic or extensible) drive shaft assembly 310 including at least two shaft sections slidably mounted to each other (four shaft sections 410, 420, 430, 440, or first, second, third and fourth drive shafts 410, 420, 430, 440—FIG. 5, in the embodiment shown). The plurality of shaft sections are slidably mounted to each other (for instance translatable with respect to one another) along a direction substantially parallel to the longitudinal axis X to conform to the length of the auger housing 200 when configured in any one of the compacted configuration, the extended configuration and the one or more intermediate configurations. The extendable drive shaft assembly 310 (and thus its shaft sections 410, 420, 430, 440 or first, second, third and fourth drive shafts 410, 420, 430, 440) are rotatable within the auger-containing cavity 210 about a rotation axis R substantially parallel to the longitudinal axis X. In other words, the shaft section 410, 420, 430, 440 are rotatably mounted to the auger housing 200 about the rotation axis R.

The auger assembly 300 further comprises a snow-gathering device divided in a plurality of snow-gathering device sections 514, 524, 534, 544 (for instance and without being limitative, helical blades 514, 524, 534, 544 that will be further described), each one being mounted to a respective one of the shaft sections 410, 420, 430, 440. As detailed below, the assembly comprising one of the snow-gathering sections and a corresponding one of the shaft sections forms one of the auger members 510, 520, 530, 540, the plurality of the auger members 510, 520, 530, 540 forming together the auger assembly 300. The snow-gathering device sections 514, 524, 534, 544 extend around (for instance are mounted to) a respective one of the shaft sections 410, 420, 430, 440. The helical blades are shaped and dimensioned to direct snow, upon rotation of the extendable drive shaft assembly 310 about the rotation axis R, towards the discharge opening 242 formed in the rear wall 240 (i.e. toward the central portion 212 of the auger-containing cavity 210, in the embodiment shown). In other words, the auger assembly 300 is configured to convey snow concentrically towards the discharge opening 242 formed in the auger housing 200 (i.e. towards the central portion 212 of the auger-containing cavity 210, in the embodiment shown). An auger assembly having any other type of snow-gathering devices, such as paddles mounted to and extending around the shaft-sections and rotatably mounted to the auger housing and extending in the auger-containing cavity could also be conceived. Moreover, it could also be conceived snow-gathering devices that would be made integral with the shaft sections and that would be designed and shaped to direct snow, upon rotation of the extendable drive shaft assembly about the rotation axis, towards the central portion of the auger-containing cavity, proximate the discharge opening formed in the rear wall. In the present description, it is understood that the actuation of the auger assembly 300 refers to the rotation of the auger assembly 300 (for instance the telescopic or extensible drive shaft assembly 310 thereof) about the rotation axis R.

In other words, in the embodiment shown, considered along the longitudinal axis X from the sidewall 222 of the first lateral portion 220 towards the sidewall 232 of the second lateral portion 230 (i.e. from the first longitudinal end portion 202 towards the second longitudinal end portion 204 of the auger housing 200), the auger assembly 300 comprises the first, second, third and fourth auger members 510, 520, 530, 540 (FIG. 6) rotatable in the auger-containing cavity 210 defined by the auger housing 200 about the rotation axis R. In yet other words, in the embodiment shown, the auger members 510, 520, 530, 540 translate relatively to each other along a direction substantially parallel to the longitudinal axis X upon displacement of at least one of the first and second longitudinal end portions 202, 204 of the auger housing 200.

It is thus understood that, in the embodiment shown, the first and fourth auger members 510, 540 are proximate (adjacent to) respectively the sidewalls 222, 232 of the first and second lateral portions 220, 230, while the second and third auger members 520, 530 extend between the first and fourth auger members 510, 540 (i.e. proximate the central portion 212 of the auger-containing cavity 210).

In the embodiment shown, the snowblower 100 (or at least the auger housing 200 with the auger assembly 300 mounted thereto) comprises a plane of symmetry P (FIG. 6) extending along a substantially vertical direction, perpendicular to the longitudinal axis X, substantially centrally. Thus, the following description of the first and second auger members 510, 520 will also apply to the third and fourth auger members 530, 540.

The first and second auger members 510, 520 are shaped and designed to translate relatively to one another along a direction substantially parallel to the longitudinal axis X (i.e. along a direction substantially parallel to the rotation axis R) substantially simultaneously with the first and second lateral portions 220, 230 of the auger housing 200 (i.e. substantially simultaneously with the first and second longitudinal end portions 202, 204).

In the embodiment shown, the first and second auger members 510, 520 comprise the first and second drive shafts 410, 420 (or first and second shaft sections 410, 420 of the telescopic drive shaft assembly 310) and the first and second helical blades 514, 524 arranged on the corresponding first and second drive shafts 410, 420 (for instance mounted to) and extending around the corresponding first and second drive shafts 410, 420.

In the embodiment shown, the first and second drive shafts 410, 420 have a substantially square cross-section so that, whereas the first and second drive shafts 410, 420 are displaceable (for instance translatable) with regards to each other along a direction substantially parallel to the rotation axis R (i.e. parallel to the longitudinal axis X, in the embodiment shown), the first and second drive shafts 410, 420 cannot be rotated with regards to each other about the rotation axis R. In other words, the first and second shaft sections 410, 420 are coupled to each other upon rotation about the rotation axis R (i.e. upon actuation of the telescopic drive shaft assembly 310). It is thus understood that the rotation of one of the first and second drive shafts 410, 420 about the rotation axis R further rotates the other one of the first and second drive shafts 410, 420 about the rotation axis R. Other cross-sectional shape could be conceived and/or anti-rotation connectors could be arranged between the first and second drive shafts 410, 420 for the rotation of one of the first and second auger members 510, 520 about the rotation axis R to be transferred to the other one of the first and second auger members 510, 520.

In yet other words, the first and second auger members 510, 520 are telescopically mounted to each other, the first drive shaft 410 being at least partially slidable into an inner cavity defined by the second drive shaft 420. Any other telescopic arrangement of the first and second drive shafts 410, 420 could be conceived. For instance, the second drive shaft could at least partially be slidable into an inner cavity defined by the first drive shaft, or the extendable drive shaft assembly could comprise more than four shaft sections telescopically mounted to each other, for instance in order to increase the length (or extended auger length) of the auger housing when configured in the at least one extended configuration. Moreover, the present disclosure is not limited to an auger assembly comprising four shaft sections with four corresponding helical blades and it could be conceived an extensible snowblower with an auger assembly comprising less or more than four shaft section and four corresponding helical blades or snow-gathering device sections.

Figure 6:
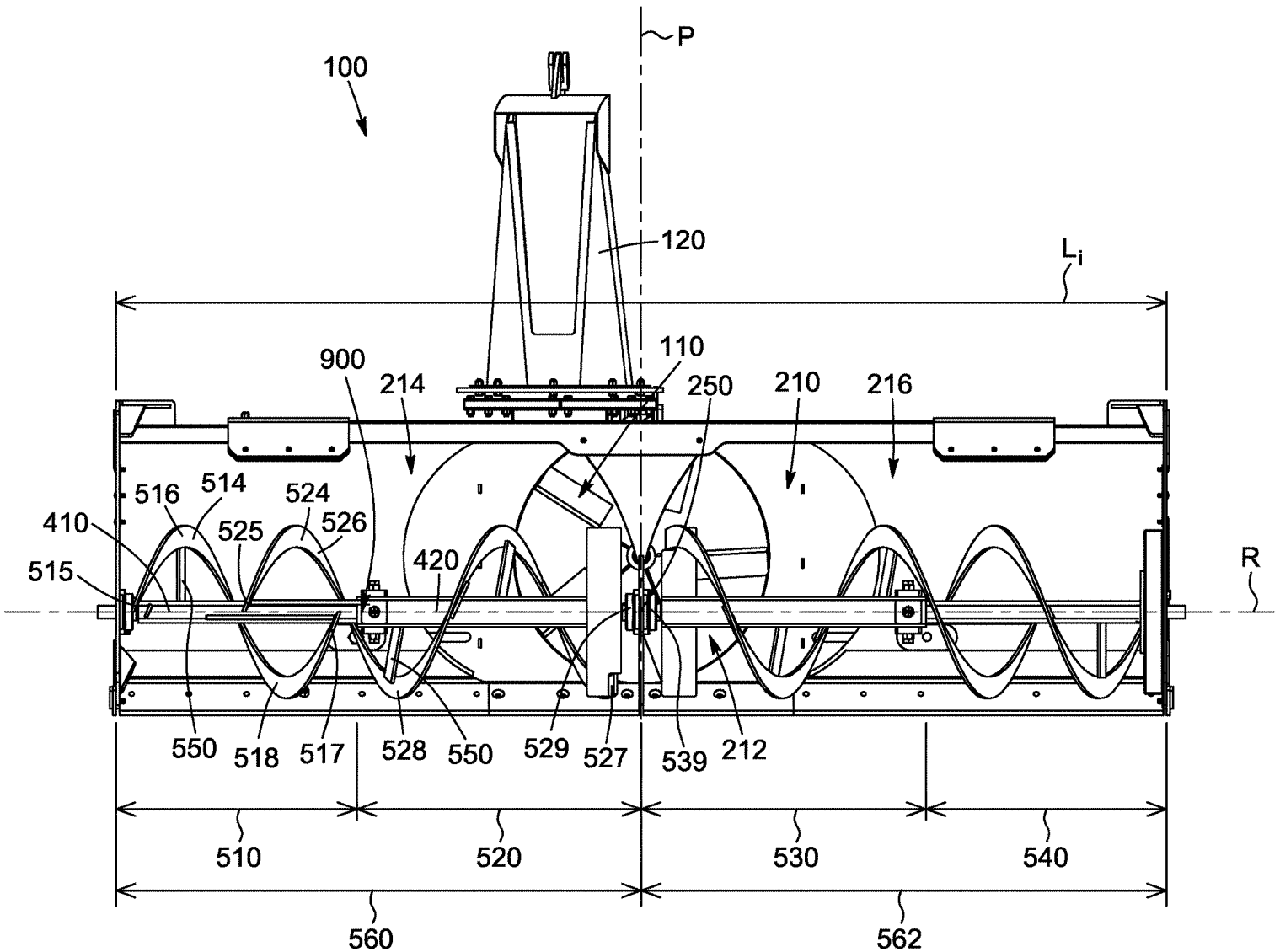
FIG. 6 is a front elevation view of the snowblower of FIG. 1, the auger housing being configured in the intermediate configuration.

Each of the first and second helical blades 514, 524 comprises an inner face 516, 526 directed towards the central portion 212 of the auger-containing cavity 210 (i.e. towards the discharge opening 242), and an opposed outer face 518, 528, directed towards an exterior of the auger-containing cavity 210, i.e. away from the discharge opening 242. Moreover, each of the first and second helical blades 514, 524 comprises a distal end 515, 525 and an opposed proximal end 517, 527 (FIG. 6).

In the shown embodiment, the first helical blade 514 forms a first number of revolutions about the first shaft section 410, and the second helical blade 524 forms a second number of revolutions about the second shaft section 420. In an embodiment, the second number of revolutions is a multiple of the first number of revolutions (i.e. the second number of revolutions is equal to the multiplication of the first number of revolutions by an integer equal to or greater than one). For instance and without being limitative, the first helical blade 514 forms about one revolution about the first drive shaft 410, whereas the second helical blade 524 forms about two revolutions about the second drive shaft 420. In the embodiment shown, the first and second helical blades 514, 524 have a substantially similar pitch. It could also be conceived first and second helical blades having different pitches or number of revolutions about their respective shafts sections that would not be multiples from each other. For instance, the pitch of at least one of the first and second helical blades could vary along the longitudinal axis of the auger housing, or the pitch of the first and second helical blades could vary progressively along the longitudinal axis from the first helical blade towards the second helical blade.

In the embodiment shown, each of the first and second auger members 510, 520 further comprises stiffeners 550 (or radial stiffeners or helical blade-stiffening members) extending radially from the first and second drive shafts 410, 420 and secured to a portion of the corresponding one of the first and second helical blades 514, 524. The stiffeners 550 or blade-stiffening members 550 are configured to securely fasten the first and second helical blades 514, 524 to the corresponding one of the first and second drive shafts 410, 420 (or reinforce the connection in-between).

Figure 2:
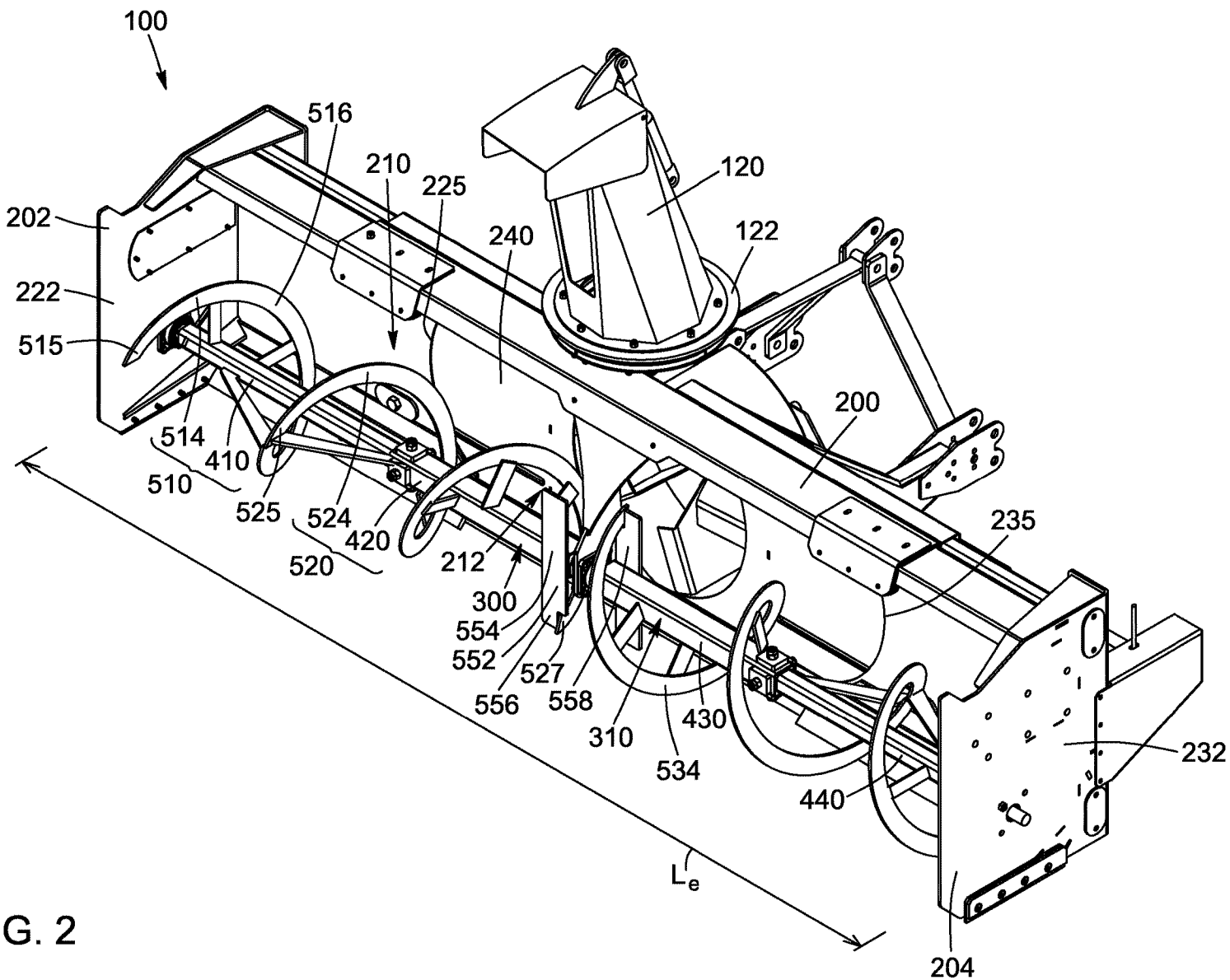
FIG. 2 is a front perspective view of the snowblower of FIG. 1, the auger housing being configured in an extended configuration.
Figure 3:
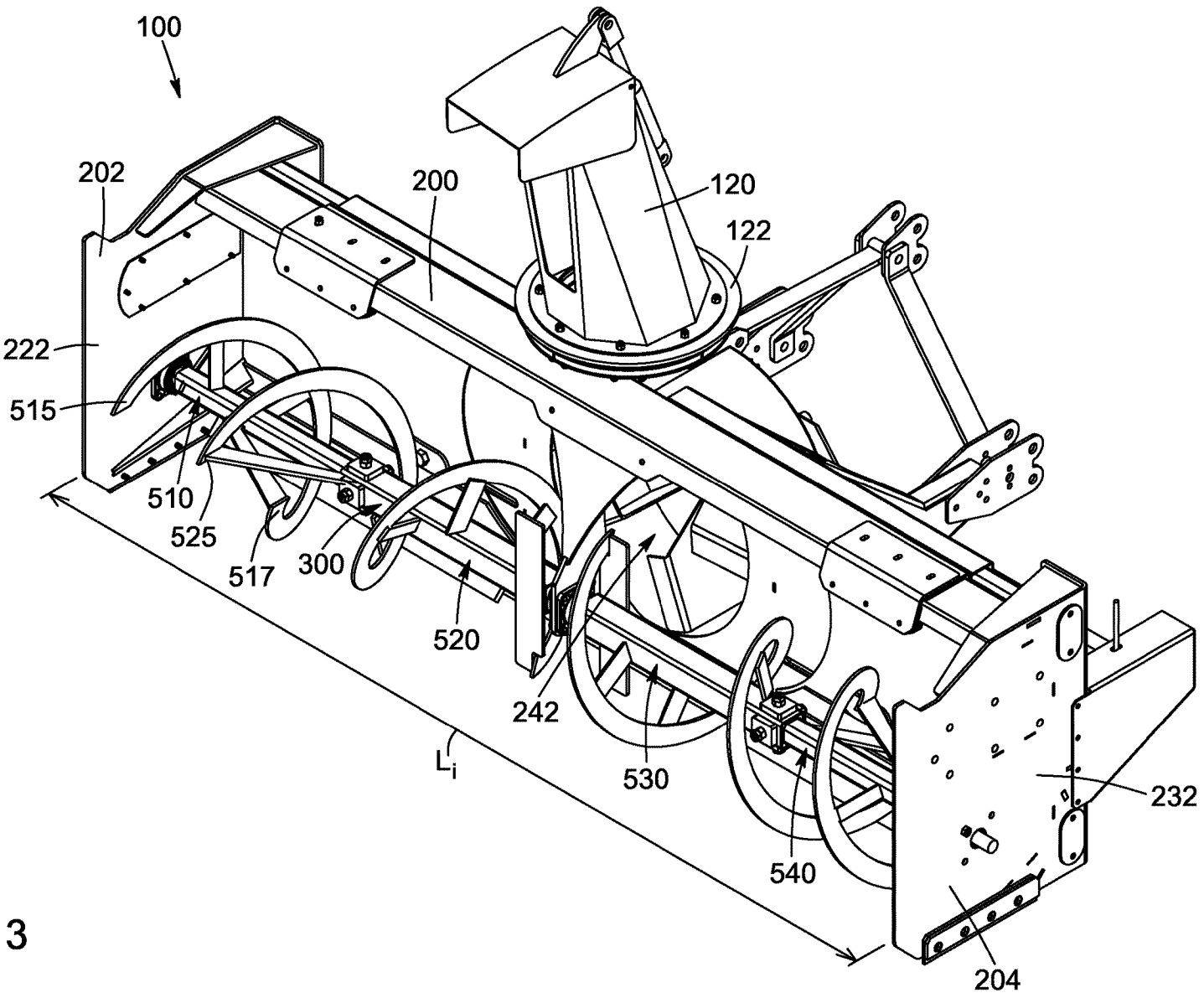
FIG. 3 is a front perspective view of the snowblower of FIG. 1, the auger housing being configured in an intermediate configuration.

Moreover, the second auger member 520, as best shown for instance in FIG. 2, further comprises a stiffening plate 552 (or helical blade-stiffening plate 552) having a first portion 554 (a central portion 554, in the embodiment shown) secured to the second shaft section 420, and a second portion 556 (a longitudinal end portion 556, in the embodiment shown) secured to the proximal end portion 527 of the second helical blade 524. The stiffening plate 552 is shaped and dimensioned to provide rigidity to the second helical blade 524 and to prevent the risk that the second helical blade 524 be damaged (for instance deformed or broken) upon actuation of the auger assembly 300. A similar stiffening plate 558 extends between the third helical blade 534 (a proximal end portion thereof) and the third shaft section 430.

In the embodiment shown, as represented for instance in FIGS. 6 and 10 to 12, the portion of the auger assembly 300 constituted by the first and second auger members 510, 520 (referred to a first half auger assembly 560 or left auger subassembly 560—FIG. 6) comprises a first drive shaft-stabilizing assembly 900 that is shaped and dimensioned to limit vibrations occurring in the first half auger assembly 560 upon actuation of the auger assembly 300 (i.e. to limit the risk that vibrations occurring in at least one of the first and second shaft sections 410, 420 be transferred to other parts of the snowblower 100). In the embodiment shown, the drive shaft-stabilizing assembly 900 comprises a first stabilizing member 910 arranged on the first shaft section 410 (on a proximal end portion 411 thereof, in the embodiment shown). The drive shaft-stabilizing assembly 900 further comprises a second stabilizing member 920 arranged on the second shaft section 420 (on a distal end portion 423 thereof, in the embodiment shown).

In the embodiment shown, the first stabilizing member 910 (or first shaft section-stabilizing member 910) comprises a plurality of stabilizing plates 912 (four in the embodiment shown), for instance at least partially made of polymer or any other wearing resistant material or anti-wear material, arranged on each one of outer faces of the proximal end portion 411 of the first shaft section 410. It is understood that the shape, dimension and numbers of the stabilizing plates depend in particular on the shape and dimension of the first shaft section. The first stabilizing member 910 further comprises, in the embodiment shown, biasing members 914 extending at least partially in an inner cavity of the proximal end portion 411, configured to bias the stabilizing plates 912 outwardly, with respect to the inner cavity, so as to urge the stabilizing plates 912 against an inner surface delimitating the inner cavity of the second shaft section 420 (FIG. 12), when the first and second shaft sections 410, 420 are at least partially engaged with each other, i.e. the proximal end portion 411 of the first shaft section 410 is inserted into the inner cavity defined at the distal end portion 423 of the second shaft section 420.

Figure 12:
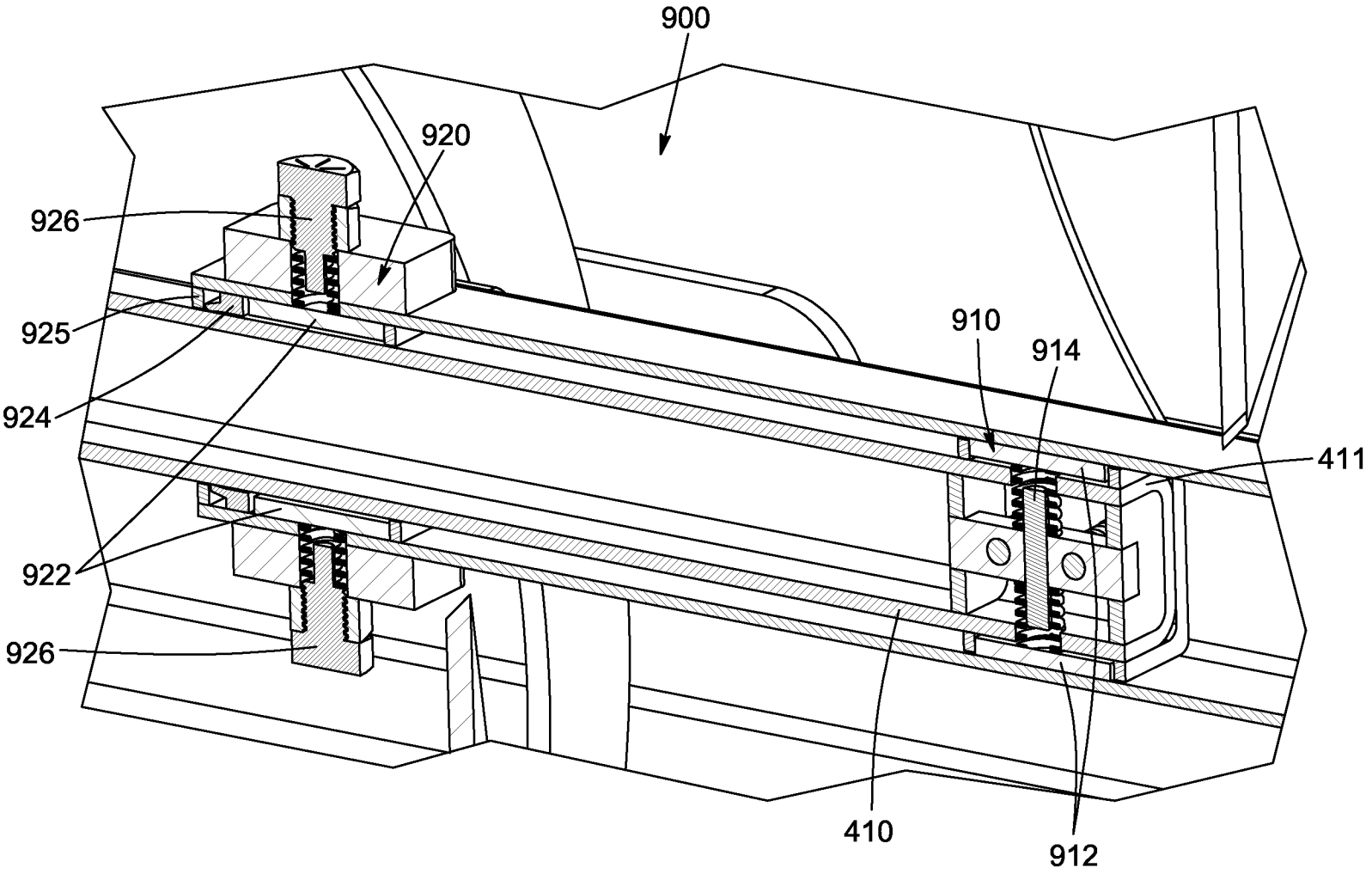
FIG. 12 is a sectional view of the drive shaft-stabilizing assembly of FIG. 7, taken along cross-section lines 12-12.

In the embodiment shown, the second stabilizing member 920 (or second shaft section-stabilizing member 920) comprises a plurality of stabilizing plates 922 (four in the embodiment shown), for instance at least partially made of polymer, arranged on the inner faces of the inner surface, of the distal end portion 423 of the second shaft section 420, and a stabilizing ring 924, for instance at least partially made of polymer, having a substantially square profile in the embodiment shown, shaped and dimensioned to be at least partially engaged in the inner cavity of the distal end portion 423 of the second drive shaft 420. It is understood that the shape, dimension and numbers of the stabilizing plates and/or the stabilizing ring depend in particular on the shape and dimension of the second shaft section. The second stabilizing member 920 further comprises, in the embodiment shown, biasing members 926 extending at least partially in the inner cavity of the distal end portion 423, configured to bias the stabilizing plates 922 inwardly, with respect to the inner cavity, so as to urge the stabilizing plates 922 against an outer surface of the first shaft section 410 (FIG. 12), when the first and second shaft sections 410, 420 are at least partially engaged with each other. In the embodiment shown, the second stabilizing member 920 further comprises a stabilizing ring-protecting member 925 (or mechanical wiper) shaped and dimensioned to be at least partially engaged in the inner cavity of the distal end portion 423 of the second drive shaft 420, at an opening portion thereof. In other words, as represented in FIG. 12, considered along a longitudinal direction of the second drive shaft 420, the stabilizing ring 924 is arranged between the stabilizing ring-protecting member 925 and the stabilizing plates 922. The stabilizing ring-protecting member 925 is configured to protect the stabilizing ring 924 and the stabilizing plates 922, for instance against external contaminants.

In the embodiment shown, the first and second shaft sections 410, 420 are least partially made of a corrosion-resistant metal/alloy, such as and without being limitative stainless steel, so as to limit the risk of corrosion of the first shaft section 410 (or inner shaft section 410) and/or the second shaft section 420 (or outer shaft section 420).

In the embodiment shown, the portion of the auger assembly 300 constituted by the third and fourth auger members 530, 540 (referred to as a second half auger assembly 562 or right auger subassembly 562—FIG. 6) comprises a substantially similar second drive shaft-stabilizing assembly.

Figure 13:
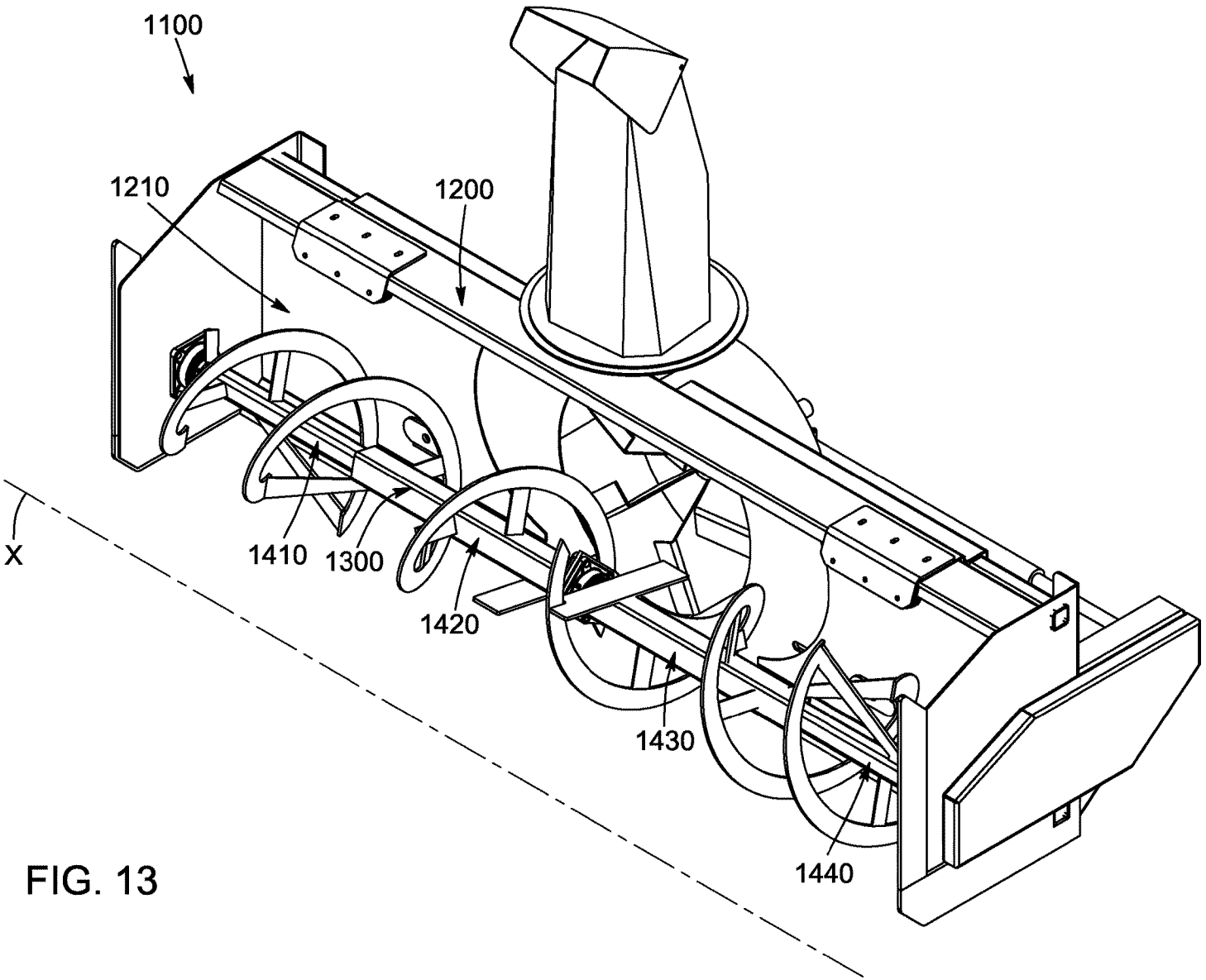
FIG. 13 is a front perspective view of a snowblower in accordance with another embodiment, the snowblower being configured in the intermediate configuration, the auger assembly being free of drive shaft-stabilizing assembly.

It is appreciated that the shape, the configuration, and the location of the drive shaft-stabilizing assembly 900 can vary from the embodiment shown or a snowblower having different first and second drive shaft-stabilizing assemblies, or only one drive shaft-stabilizing assembly could also be conceived. As represented in FIG. 13, the snowblower 1100 in accordance with a second embodiment comprises an auger housing 1200 and an auger assembly 1300 mounted to the auger housing 1200 and first, second, third and fourth drive shaft sections 1410, 1420, 1430, 1440 with no drive shaft-stabilizing assemblies. The stabilization of the auger assembly 1300 could be provided by the first and the second drive shaft sections 1410, 1420, on the one hand, and the third and fourth drive shaft section 1430, 1440, on the other hand, being substantially stably fitted with each other.

In the embodiment shown, the first and second auger members 510, 520 both extend in a same half portion 214 of the auger-containing cavity 210 (in the left half portion of the auger-containing cavity 210 when viewed from a front portion of the snowblower 100, as represented in FIG. 6). The first and second blades 514, 524 are of the same type (of the left-handed type, in the embodiment shown). The third and fourth auger members 530, 540 extend in a different half portion 216 of the auger-containing cavity 210 (in the right half portion of the auger-containing cavity 210 when viewed from the front portion of the snowblower 100, as represented in FIG. 6). Thus, whereas the third and fourth helical blades 534, 544 are of the same type, they are of a type different than the one of the first and second helical blades 514, 524 (i.e. the third and fourth blades 534, 544 are, in the embodiment shown, of the right-handed type) to drive the collected snow towards the discharge opening 242 formed in the rear wall 240. In other words, the first and second helical blades 514, 524 have a roll of one of the clockwise and anticlockwise types, whereas the third and fourth helical blades 534, 544 have a roll of the other of the clockwise and anticlockwise types. In yet other words, the telescopic drive shaft assembly 300 comprises left and right telescopic drive shaft subassemblies, each of the left and right telescopic drive shaft subassemblies a plurality of shaft sections slidably mounted to each other. The snow-gathering devices 514, 524, 534, 544 comprise left 514, 524 and right 534, 544 snow-gathering devices arranged respectively on the left and right snow-gathering drive shaft subassemblies and comprising respectively left and right helical blades, one of the left and right helical blades being right-handed, while the other one of the left and right helical blades is left-handed, so that, upon actuation of the auger assembly 300, the snow-gathering devices direct snow towards the discharge opening 242 formed in the auger housing 200.

In the embodiment shown but without being limitative, the auger housing 200 further comprises a shaft-supporting wall portion 250 (as best shown in FIG. 7) extending in the auger-containing cavity 210 substantially centrally therein. For instance, the shaft-supporting wall portion 250 is secured to the rear wall 240 (for instance to lower and/or upper portions of an inner face thereof, for instance via a substantially triangular cover portion mounted to the upper portion of the inner face thereof) and extends forwardly therefrom. In the embodiment shown, a proximal end 529 of the second drive shaft 420 is coupled to (for instance mounted to or connected to) the shaft-supporting wall portion 250 (i.e. to a first face thereof). A proximal end 539 of the third drive shaft 430 is coupled to (for instance mounted to or connected to) an opposed second face of the shaft-supporting wall portion 250. It is thus understood that the shaft-supporting wall portion 250 is configured to support a central portion of the auger assembly 300. It could also be conceived an auger housing with no shaft-supporting wall portion extending the auger-containing cavity thereof, or with more than one single central shaft-supporting wall portion.

It is appreciated that the shape, the configuration, the location and the number of the auger members, as well as the shape, configuration, location and relative dimensions of the helical blades can vary from the embodiment shown. It could for instance be conceived an auger assembly comprising a one-pieced central auger member, instead of the distinct above-disclosed second and third auger members. The number, shape, configuration and arrangement of the radial stiffeners can also vary from the embodiment shown.

Operation of the Extensible Snowblower

As mentioned above, the auger assembly 300 according to the present disclosure is configured so that the extendable—or telescopic—drive shaft assembly 310 conforms to the length of the auger housing 200 when configured in each one of the compacted configuration, the extended configuration and the one or more intermediate configurations.

Figure 4:
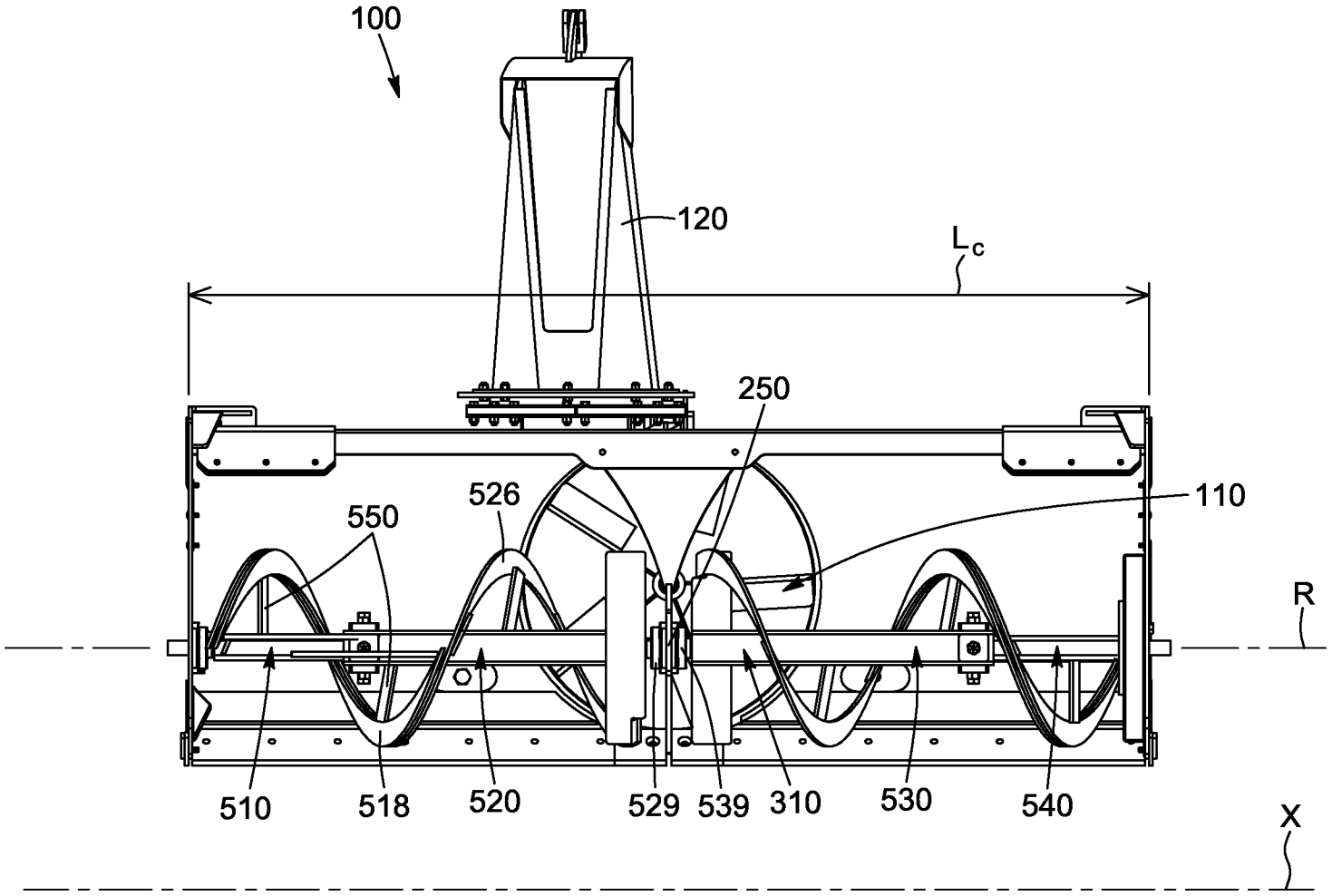
FIG. 4 is a front elevation view of the snowblower of FIG. 1, the auger housing being configured in the compacted configuration.

To this end, as represented in FIGS. 1, 4 and 7, when the auger housing 200 is configured in the compacted configuration, a portion of the inner face 516 of the first helical blade 514 is substantially superposed to a portion of the outer face 528 of the second helical blade 524. In the embodiment shown, an entirety of the inner face 516 of the first helical blade 514 is superposed to the portion of the outer face 528 of the second helical blade 524. In other words, the single revolution of the first helical blade 514 is superposed to one of the revolutions (to a distal one, in the embodiment shown) of the second helical blade 524.

When the auger housing 200 is configured in the compacted configuration, as best shown in FIGS. 1, 4 and 7, the distal ends 515, 525 of the first and second helical blades 514, 524 (forming respectively at least partially distal ends of the first and second auger members 510, 520) are proximate (i.e. adjacent to) each other, and are proximate (i.e. adjacent to) the sidewall 222 of the first lateral portion 220.

In the embodiment shown, when the auger housing 200 is configured in the compacted configuration, a portion of the auger assembly 300 constituted by the first and second auger members 510, 520 (referred to the above-mentioned first half auger assembly 560 or left auger subassembly 560—FIG. 6) which extend in the first half portion 214 of the auger-containing cavity 210 comprises a partially superposed helical blade. The partially superposed helical blade of the first half auger assembly 560 comprises, in the embodiment shown, about two revolutions, one of the two revolutions being formed by the superposition of the first helical blade 514 and a portion of the second helical blade 524, the second of the two revolutions of the helical blade of the first half auger assembly 560 being formed by the remaining portion of the second helical blade 524 (i.e. by a proximal revolution of the helical blade 524 of the second auger member 520).

When the auger housing 200 is configured in the extended configuration, as represented in FIGS. 2, 5 and 8, the distal end 525 of the second helical blade 524 is proximate (or adjacent to) the proximal end 517 of the first helical blade 514. In the embodiment shown, the first and second helical blades 514, 524 are shaped and dimensioned so that, when in the extended configuration, the distal end 525 of the second helical blade 524 is substantially in register with the proximal end 517 of the first helical blade 514. A substantial continuity is thus formed between the inner faces 516, 526 of the first and second helical blades 514, 524 and between the outer faces 518, 528 of the first and second helical blades 514, 524.

In the embodiment shown, when the auger housing 200 is configured in the extended configuration, the portion of the auger assembly 300 constituted by the first and second auger members 510, 520 (referred to the first half auger assembly 560) which extend in the first half portion 214 of the auger-containing cavity 210 comprises about three revolutions, one of which (i.e. the distal one) being formed by the first helical blade 514 and the two other revolutions (i.e. a central one and the proximal one) being formed by the second helical blade 524.

In the embodiment shown, at least some of the radial stiffeners 550 are connected proximate the proximal end 517 of the first helical blade 514 and the distal end 525 of the second helical blade 524 to increase the rigidity of the assembled helical blade when the auger housing 200 is configured in the extended configuration.

The snowblower 100 further comprises a housing actuator 600 to selectively configure the auger housing 200 in any one of the compacted configuration, the extended configuration and the one or more intermediate configurations.

In the embodiment shown, the housing actuator 600, represented in FIG. 9, comprises first and second (or right and left) housing actuators 610, 620 configured to cooperate respectively and independently with the first and second lateral portions 220, 230 so as to translate independently the first and second lateral portions 220, 230 from one of the compacted configuration, the extended configuration and the one or more intermediate configurations to another one. It is thus understood that the first and second lateral portions 220, 230 can either be translated simultaneously or sequentially or only one of the first and second housing actuators 610, 620 could be actuated.

For instance, the first and second housing actuators 610, 620 each comprise at least one hydraulic, electric or pneumatic cylinder having a first end 612, 622 mounted to the corresponding one of the first and second lateral portions 220, 230 (for instance to the corresponding one of the first and second sidewalls 222, 232 thereof) and a second end mounted to the rear wall 240 (for instance to an outer face 244 or a rear extension thereof) or to any other part of the auger housing 200 with regards to which the corresponding one of the first and second lateral portions 220, 230 is slidably mounted.

In the embodiment shown, the snowblower 100 further comprises auger-assembly driving member 630 extending, for instance, between one of the first and second lateral portions 220, 230 and a central portion of the rear wall 240, proximate the impeller 110. The auger-assembly driving member 630 is shaped and dimensioned to actuate the auger assembly 300 (i.e. to rotate the auger assembly 300 about the rotation axis R).

It is appreciated that the shape, the configuration, the number and the respective arrangement of the first and second housing actuators 610, 620 can vary from the embodiment shown. For instance, it could be conceived a housing actuator, comprising hydraulic and/or pneumatic and/or electric cylinder or any other adapted actuator that would extend directly between the first and second lateral portions for the first and second lateral portions (and more particularly the corresponding lateral portions) to slide relative to each other. It could also be conceived a snowblower having manual actuators to configure the auger housing in any one of the compacted, extended and/or intermediate configurations and/or comprising biasing members to maintain the auger housing in any one of the compacted, extended and/or intermediate configurations.

In the embodiment in which the first and second lateral portions would have no sidewall, the housing actuator could be configured to vary the length of the auger housing and/or a length of the extendable drive shaft assembly from a central portion thereof.

Moreover, the present disclosure is not limited to a snowblower which would be configured to be symmetrically deployed: it could also be conceived a snowblower having a first lateral portion configurable in the extended configuration or in one of the intermediate configurations, while a second lateral portion would be configurable in the compacted configuration or in another one of the intermediate configurations.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited by the scope of the appended claims.

The invention claimed is:

1. A snowblower, comprising:

an auger housing extending along a longitudinal axis and being configurable in a compacted configuration and in at least one extended configuration wherein a length of the auger housing considered along the longitudinal axis is greater in the at least one extended configuration than in the compacted configuration; and an auger assembly mounted to the auger housing and comprising:

a telescopic drive shaft assembly including at least first and second shaft sections slidably mounted to each other to substantially conform to the length of the auger housing in each one of the compacted configuration and the at least one extended configuration;

snow-gathering devices mounted to the at least first and second shaft sections and rotatable therewith; and a drive shaft-stabilizing assembly having:

a first stabilizing member arranged on a proximal end portion of the first shaft section and being at least partially urged against an inner surface at least partially delimiting an inner cavity of the second shaft section; and a second stabilizing member arranged on a distal end portion of the second shaft section and being at least partially urged against an outer surface of the first shaft section.

2. The snowblower according to claim 1, wherein the at least first and second shaft sections are translatable with respect to each other along a direction substantially parallel to the longitudinal axis and wherein the at least first and second shaft sections are rotatably mounted to the auger housing about a rotation axis substantially parallel to the longitudinal axis, the at least first and second shaft sections being angularly coupled to each other upon rotation of any one of the at least first and second shaft sections about the rotation axis.

3. The snowblower according to claim 1, wherein the snow-gathering devices comprise at least first and second helical blades extending around a respective one of the at least first and second shaft sections, each of the at least first and second helical blades having:

a distal end; and a proximal end;

wherein the distal end of the second helical blade is adjacent to the proximal end of the first helical blade when the auger housing is configured in said at least one extended configuration; and wherein the distal ends of the first and second helical blades are adjacent each other when the auger housing is configured in the compacted configuration.

4. The snowblower according to claim 3, wherein each of the at least first and second helical blades has:

an inner face; and an opposed outer face;

wherein at least a portion of the inner face of the first helical blade is substantially superposed to at least a portion of the outer face of the second helical blade when the auger housing is configured in the compacted configuration; and wherein a substantial continuity is formed between at least one of the inner faces of the first and second helical blades and the outer faces of the first and second helical blades, when the auger housing is configured in said at least one extended configuration.

5. The snowblower according to claim 1, wherein the first stabilizing member comprises at least one stabilizing plate on an outer face of the proximal end portion of the first shaft section and a biasing member urging the stabilizing plate against the inner surface at least partially delimiting the inner cavity of the second shaft section.

6. The snowblower according to claim 1, wherein the second stabilizing member comprises at least one stabilizing plate arranged on an inner face of the inner surface of the distal end portion of the second shaft section and a biasing member urging the stabilizing plate against the outer surface of the first shaft section.

7. The snowblower according to claim 1, wherein the auger housing comprises first and second lateral portions displaceable with respect to each other, the telescopic drive shaft assembly comprising first and second distal shaft end portions mounted respectively to the first and second lateral portions, wherein the auger housing further comprises a rear wall, at least one of the first and second lateral portions being slidably mounted to the rear wall.

8. The snowblower according to claim 6, wherein the second stabilizing member further comprises a stabilizing ring at least partially engaged in an inner cavity of the distal end portion of the second shaft section.

9. The snowblower according to claim 7, further comprising at least one housing actuator to selectively configure the auger housing in any one of the compacted and the at least one extended configuration, the at least one housing actuator comprising at least one of a hydraulic cylinder, an electric cylinder and a pneumatic cylinder having a first end mounted to one of the first and second lateral portions and a second end engaged with the rear wall, wherein the at least one housing actuator comprises first and second housing actuators cooperating respectively and independently with the first and second lateral portions.

10. A snowblower, comprising:

an extensible auger housing extending along a longitudinal axis and comprising first and second longitudinal end portions defining an auger length in-between, wherein the first and second longitudinal end portions are displaceable with respect to each other for the extensible auger housing to be configurable in:

a compacted configuration wherein the extensible auger housing has a compacted auger length, and at least one extended configuration wherein the extensible auger housing has an extended auger length greater than the compacted auger length; and an auger assembly mounted to the extensible auger housing and extending between the first and second longitudinal end portions, the auger assembly comprising at least first and second auger members translating relatively to one another along a direction substantially parallel to the longitudinal axis upon displacement of at least one of the first and second longitudinal end portions;

wherein each of the at least first and second auger members comprises:

a drive shaft;

a helical blade extending around and radially spaced-apart from the drive shaft; and a plurality of radial stiffeners extending radially from the drive shaft and secured to a portion of the helical blade;

wherein the plurality of radial stiffeners of at least one of the first and second auger members comprise a stiffening plate having a first portion secured to a proximal end portion of the corresponding drive shaft and a second portion secured to a proximal end portion of the corresponding helical blade.

11. The snowblower according to claim 10, wherein the helical blade of each of the first and second auger members comprises an inner face and an opposed outer face, wherein at least a portion of the inner face of the helical blade of the first auger member is substantially superposed to at least a portion of the outer face of the helical blade of the second auger member when the extensible auger housing is configured in the compacted configuration; and wherein a substantial continuity is formed between at least one of the inner faces of the helical blades of the first and second auger members and the outer faces of the helical blades of the first and second auger members, when the extensible auger housing is configured in said at least one extended configuration.

12. The snowblower according to claim 11, wherein the helical blades of each of the at least first and second auger members have a distal end and a proximal end, wherein the distal end of the helical blade of the second auger member is adjacent to the proximal end of the helical blade of the first auger member when the extensible auger housing is configured in said at least one extended configuration and wherein the distal ends of the helical blades of the first and second auger members are adjacent to each other when the extensible auger housing is configured in the compacted configuration.

13. The snowblower according to claim 10, wherein, in the compacted configuration, at least two of the plurality of radial stiffeners of at least one of the first and second auger members at least partially overlap one another, and wherein in one of the at least one extended configuration, the at least two of the plurality of radial stiffeners are longitudinally spaced apart.

14. The snowblower according to claim 12, wherein the plurality of radial stiffeners of the first and second auger members comprises a proximal radial stiffener connected proximate the proximal end of the first helical blade and a distal radial stiffener connected proximate the distal end of the second helical blade.

15. A walk-behind snowblower assembly, comprising:

a chassis having a front portion, a rear portion and a handle member extending from the rear portion; and a snowblower according to claim 1 mounted to the front portion of the chassis.

16. A motorized snowblower assembly, comprising:

a motorized vehicle having a front portion and a rear portion; and a snowblower according to claim 1 mounted to one of the front and rear portions.

17. A snowblower, comprising:

an auger housing defining an auger-containing cavity extending along a longitudinal axis and being configurable in a compacted configuration and in at least one extended configuration wherein a length of the auger housing considered along the longitudinal axis is greater in the at least one extended configuration than in the compacted configuration;

an auger assembly mounted to the auger housing and comprising:

a telescopic drive shaft assembly comprising left and right drive shaft subassemblies, at least one of the left and right drive shaft subassemblies including at least first and second shaft sections slidably mounted to each other to substantially conform to the length of the auger housing in each one of the compacted configuration and the at least one extended configuration; and snow-gathering devices mounted to the left and right drive shaft subassemblies and rotatable therewith; and at least one shaft-supporting wall portion extending in the auger-containing cavity, proximal end portions of the left and right drive shaft subassemblies being coupled to opposed faces of the at least one shaft-supporting wall portion, and distal end portions of the left and right drive shaft subassemblies being coupled to respective sidewalls of the auger housing.

18. The snowblower according to claim 17, wherein the at least one shaft-supporting wall portion is secured to an inner face of a rear wall of the auger housing and extends forwardly therefrom.

19. The snowblower according to claim 17, wherein the auger housing comprises first and second lateral portions displaceable with respect to each other, the left and right drive shaft subassemblies comprising respectively left and right distal shaft end portions mounted respectively to the first and second lateral portions, wherein the auger housing further comprises a rear wall, at least one of the first and second lateral portions being slidably mounted to the rear wall, wherein the rear wall of the auger housing comprises a discharge opening formed therein with at least one the first and second lateral portions comprising a proximal end portion at least partially bordering the discharge opening when the auger housing is configured in the compacted configuration, the at least one shat-supporting wall portion extending proximate the discharge opening.

20. The snowblower according to claim 19, further comprising an impeller at least partially extending in the discharge opening and a snow discharge chute defining a snow discharge cavity in fluid communication with the discharge opening, the snow discharge chute extending substantially upwardly from the auger housing.

* * * * *